US006641250B2

(12) United States Patent
Saito

(10) Patent No.: US 6,641,250 B2
(45) Date of Patent: Nov. 4, 2003

(54) CAP FOR INK-JET RECORDING APPARATUS, AND INK-JET RECORDING APPARATUS

(75) Inventor: Hiroyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/902,758

(22) Filed: Jul. 12, 2001

(65) Prior Publication Data

US 2002/0024551 A1 Feb. 28, 2002

(30) Foreign Application Priority Data

Jul. 17, 2000 (JP) ..... 2000-216701

(51) Int. Cl.[7] ..... B41J 2/165
(52) U.S. Cl. ..... 347/31
(58) Field of Search ..... 347/29, 30, 31; 15/244.1; B41J 2/165

(56) References Cited

U.S. PATENT DOCUMENTS 4,543,589 A * 9/1985 Terasawa ..... 347/31
5,245,362 A 9/1993 Iwata et al. ..... 347/23
6,109,725 A 8/2000 Saikawa et al. ..... 347/33

FOREIGN PATENT DOCUMENTS

EP 845360 A2 * 3/1998 ..... B41J/2/165
JP 2000062202 A * 2/2000 ..... B41J/2/165

OTHER PUBLICATIONS

Frank Cost, Pocket Guide to Digital Printing, 1997, Thomson Learning, p. 99–101.*

U.S. application No. 09/679,605, filed Oct. 5, 2000.

* cited by examiner

*Primary Examiner*—Judy Nguyen
*Assistant Examiner*—Blaise Mouttet
(74) *Attorney, Agent, or Firm*—Fitzpatrick, Cella, Harper & Scinto

(57) ABSTRACT

An ink-jet recording apparatus includes a recording head upon which ink discharging orifices are arrayed, a cap, having a perimeter coming into contact with a discharging orifice face on the recording head and a sealing space within the perimeter of the cap for covering the discharging orifices, an ink absorbing member provided in the sealing space, and a holding member provided within the sealing space at a position separated from the perimeter so as not to come into contact with the discharging orifice face when the perimeter of the cap is in contact with the discharging orifice face, to hold and prevent the ink absorbing member from being removed from the sealing space. Thus, the ink absorbing member is tightly held in contact to the sealing space of the cap so as to not depart therefrom, and particularly so as to not depart from a suctioning opening at the bottom face of the cap.

25 Claims, 26 Drawing Sheets

CAP FOR INK-JET RECORDING APPARATUS, AND INK-JET RECORDING APPARATUS

BACKGROUND OF THE INVENTION

1. Field of the Invention

The present invention relates to an ink-jet recording apparatus which discharges ink from a recording head to form images on a recording medium, and a cap for an ink-jet recording apparatus for maintaining discharging of ink from nozzles of the recording head in a suitable state. In addition to common printing apparatuses, the present invention can be applied to photocopiers, facsimile apparatuses having communication systems, word processors or the like having printing units, and further to industrial recording equipment which is combined with various processing devices.

2. Description of the Related Art

Recording apparatuses having the functions of printers, photocopiers, facsimile devices, etc., and recording apparatuses used as output devices of complex electronic equipment including computers, word processors, or the like, or workstations, are configured to record images based on image information on recording media such as paper, thin plastic plates, or the like.

Of such recording apparatuses, recording apparatuses which use the ink-jet method (i.e., ink-jet recording apparatuses) perform recording by discharging ink onto a recording medium from a recording head serving as the recording means. Such ink-jet recording apparatuses have the following advantages.

The recording head can be readily reduced in size, fine images can be recorded at high speeds, recording can be performed on plain paper with no special processing required, and the running cost is low. Being a non-impact method, there is little noise, and moreover color images can be readily recorded using inks of multiple colors. Also, recording can be performed at even higher speeds using line-type ink-jet recording apparatuses which use line-type recording heads with a great number of nozzles arrayed in the width direction of the recording sheet.

Particularly, with ink-jet type recording heads which discharge ink using thermal energy, a high-density fluid channel array (nozzle array) made up of electro-thermal converters, electrodes, fluid channel walls, ceiling, etc., formed on a substrate, can be realized by semiconductor manufacturing processes such as etching, vapor deposition, sputtering, and so forth, thereby facilitating even further reduction in size.

With ink-jet recording apparatuses, images are recorded on a recording medium by discharging ink from the nozzles according to electric signals. With such ink-jet recording apparatuses, in the event that air intrudes into the nozzles or the viscosity of the ink increases or so forth due to drying, the nozzle becomes incapable of discharging ink, and ink droplets according to the electric signals cannot be discharged from the nozzles.

As one method for recovering from such a state wherein the nozzle is incapable of discharging ink, there is the suctioning method (suctioning recovery) wherein ink which does not contribute to recording to the image is suctioned and removed from the tip of the nozzle. In this suctioning recovery, a technique for generating negative pressure for suctioning ink so as to suction the ink is normally used. As one such arrangement, there is a tube pump wherein negative pressure is generated within a pump tube by rotating a pump roller in contact with the pump tube, i.e., by working with the pump.

An example of a suctioning recovery device using such a tube pump is a configuration wherein a suctioning opening and an atmosphere communicating opening are formed within a cap which is capable of capping the recording head, and a tube pump is connected to the suctioning opening, while a valve rubber opened and closed by a valve lever is connected to the atmosphere communicating opening. The cap and tube pump are driven relating to the rotating direction of a PG motor, and the valve lever is driven according to the rotating direction of a recording medium discharging roller by an LF motor.

That is to say, first, once the discharging roller is reverse rotated, the valve lever opens the valve rubber so that the atmosphere communicating opening is opened. Subsequently, forward rotation of the PG motor brings the cap into contact with the face of the recording head upon which are formed the ink discharging orifices, thereby capping the recording head. At this time, the tube pump is driving forwards by forward driving of the PG motor, but forward driving does not bring the pump roller into contact with the pump tube, so there is no negative pressure generated.

Subsequently, the discharging roller is rotated forwards, so the valve lever closes the valve tube, and the atmosphere communicating opening is closed. Further, reverse rotating of the PG motor drives the tube pump reverse. Thus, the pump roller rotates while being pressed against the pump tube, working the pump tube to generate negative pressure. This generated negative pressure is introduced from the suctioning opening into the cap. At this time, the cap has capped the recording head and the atmosphere communicating opening is closed by the valve rubber, so viscous ink no longer suitable for recording, bubbles, etc., are suctioned out from the ink discharging orifices of the recording head by this negative pressure introduced within the cap. Further, the viscous ink and air bubbles are forcibly suctioned out from the suctioning opening within the cap via the suctioning opening and an ink suctioning member provided above the atmosphere communicating opening.

Subsequently, reverse rotating of the discharging roller causes the valve lever to open the valve rubber. Thus, the atmosphere communicating opening of the cap opens, and the pressure within the cap becomes that of the ambient atmosphere. Consequently, ink is no longer suctioned and discharged from the ink discharging orifices of the recording head, and further the residual ink within the cap is instantaneously discharged from the suctioning opening by the capillary action of the ink absorbing member. Also, the ink within the pump tube is also suctioned, and discharged from the ink discharging end of the pump tube. This action is called "pneumatic suctioning". Subsequently, the PG motor stops, and the discharging roller rotates forward, thereby causing the cap to be distanced from the face of the recording head upon which are formed the ink discharging orifices, the capping is disengaged, and the valve lever closes the valve rubber. Thus, the series of actions for the suctioning recovery operation is completed.

Such conventional suction recovery devices still have the following problems.

As described above, in the suction recovery action, the ink suctioned out from the recording head is drawn to the suctioning opening within the cap by both the capillary action at the air holes of the ink absorbing member, and the negative pressure, and is thus discharged. The ink absorbing member is normally assembled into the bottom face within the cap, and the ink absorbing member has been prevented from rising upward by a ledge-shaped rising prevention member provided on the inner circumference wall of a rib configuring the perimeter of the cap.

However, the area to be capped by the cap is increasing due to the increase in ink discharging nozzles for color recording heads and high-quality high-resolution recording heads. Thus, the area of the ink absorbing member also increases, and the distance between the suctioning opening serving as the ink discharging opening within the cap and the ledge-shaped rising prevention member also tends to increase. Accordingly, deformation in the ink absorbing member and the cap and margin-of-error thereof in precision in manufacturing, have marked effects on the state of contact between the ink absorbing member and the suctioning opening, and there has been the possibility that the gap between these would spread.

In the state that gap between the ink absorbing member and the suctioning opening has spread, air flows in from the suctioning opening through this gap at the time of the above-described pneumatic suctioning more readily (i.e., air flows in from the atmosphere communicating opening and end of absorbing material), air is discharged from the suctioning opening in great amounts, resulting in a phenomena wherein ink existing within and upon the ink absorbing members not discharged but remains within.

In the event that ink remains within the cap, this means that a great amount of ink adheres to the recording head side at the time of opening the cap, so ink may splatter in great amounts at the time of the wiping action (an action wherein the discharging face is wiped with a wiping blade) normally performed following suctioning and soil the interior of the apparatus. Also, ink adhering to the discharging orifices of the recording head may lead to ink of a different color finding its way into the discharging orifices, resulting a mixed color phenomena wherein the image is printed with a color other than that intended.

Also, the ink absorbing member repeatedly swells and shrinks by 2 to 3% due to absorbing ink and drying, so the above-mentioned ledge-shaped rising prevention member alone is insufficient to position the absorbing material in a sure manner so that there is no deformation thereof, and the assembly state is unstable.

SUMMARY OF THE INVENTION

Accordingly, it is an object of the present invention to provide a cap for an ink-jet recording apparatus, and an ink-jet recording apparatus, wherein the ink absorbing member is tightly held in contact to the sealing space of the cap so as to not depart therefrom.

Also, it is another object of the present invention to provide a cap for an ink-jet recording apparatus, and an ink-jet recording apparatus, wherein the suctioning opening at the bottom face of the cap and the ink absorbing member can be constantly held in close contact in a secure manner.

According to one aspect of the present invention, provided are a cap, having a perimeter coming into contact with a discharging orifice face upon which a discharging orifice for discharging ink is provided, and a sealing space within the perimeter for covering the discharging orifice; an ink absorbing member provided in the sealing space; and a holding member for holding the ink absorbing member to prevent the ink absorbing member from being removed from the sealing space, provided within the sealing space at a position separated from the perimeter so as not to come into contact with the discharging orifice face when the perimeter of the cap is in contact with the discharging orifice face.

Also, according to another aspect, an ink-jet recording apparatus comprises: a recording head for recording images on recording media upon which an ink discharging orifice is provided; a cap, having a perimeter coming into contact with a discharging orifice face upon which a discharging orifice for discharging ink is provided, and a sealing space within the perimeter for covering the discharging orifice; an ink absorbing member provided in the sealing space; and a holding member for holding the ink absorbing member to prevent the ink absorbing member from being removed from the sealing space, provided within the sealing space at a position separated from the perimeter so as not to come into contact with the discharging orifice face when the perimeter of the cap is in contact with the discharging orifice face.

According to the present invention, a holding member is provided within the sealing space at a position separated from the perimeter so as not to come into contact with the discharging orifice face when the perimeter of the cap is in contact with the ink discharging orifice face, so the ink absorbing member can be securely held so as to not be removed from the sealing space, and also adverse effects on the ink discharging orifice face, such as re-adhering of ink and the like due to the holding member, can be prevented.

Also, positioning a holding member for securely holding the ink absorbing member against the bottom face of the cap near the suctioning opening allows the suctioning opening of the cap and the ink absorbing member to be held in close contact in a sure manner at all times, so even in the event that the cap is large, the effects of deformation in the ink absorbing member and the cap and margin-of-error thereof in precision in manufacturing on the state of contact between the ink absorbing member and the suctioning opening can be suppressed. Accordingly, air can be prevented from flowing into the suctioning opening, the phenomena wherein ink remains within the ink absorbing member within being discharged therefrom can be prevented at the time of opening the cap and so forth, and accordingly, mixing of colors due to ink adhering to the recording head and soiling of the inside of the apparatus due to splattering of the ink at the time of wiping, can be prevented.

Also, forming the holding member at a position not facing ink discharge orifices of the recording head allows the ink suctioned from the ink discharging orifices to be speedily absorbed by the ink absorbing member, thereby preventing mixing of colors at the discharging orifices due to ink staying around the ink discharging orifice face.

Also, configuring the holding member so as to not protrude above the upper face of the ink absorbing member in the state of the suctioning opening of the cap and the ink absorbing member being in contact prevents ink from adhering to the ink discharging orifice face in a more effective manner. Also, there is less necessity to consider the positional relation between the holding member and the ink discharging orifices, so the degree of freedom in placement is greater for both.

Also, providing an elastic member which deforms by contact with the ink absorbing member of the holding member at the point of contact with the ink absorbing member allows positional change of the ink absorbing member as to the cap to be restricted, so even in the event that the ink absorbing member repeatedly sells and shrinks due to absorbing ink and drying, the ink absorbing member can be positioned in a sure manner without causing deformation of the ink absorbing member, thereby stabilizing the assembly state of the ink absorbing member.

Also, forming the holding member or the elastic member integrally with the cap, with the same material as that of the cap, enables costs to be reduced.

Further, forming the elastic member of a rib having a cross-sectional form of a triangle with the apex thereof toward the ink absorbing member further facilitates deforming of the elastic member, and suppresses deformation of the ink absorbing member.

Further objects, features and advantages of the present invention will become apparent from the following description of the preferred embodiments with reference to the attached drawings.

DESCRIPTION OF THE PREFERRED EMBODIMENTS

Embodiments relating to a recording apparatus according to the present invention will now be described, with reference to the drawings.

In the present specification, the term "print" (or sometimes referred to as "record") implies a broad definition of the forming of images, designs, patterns, and so forth on a printing medium or processing a medium with regard to such images, designs, patterns, and so forth, regardless of whether meaningful information such as characters, shapes, etc., are formed, i.e., regardless of whether that which is formed is meaningful or not, and regardless of whether that which is formed is manifested so as to be perceivable by the human eye. Also, the term "printing medium" implies not only paper commonly used with printing apparatuses, but also broadly covers any article capable of receiving ink, such as textiles, plastic film, metal plates and the like, glass, ceramics, wood, leather, and so forth. Further, the term "ink" (also referred to as "liquid") should be accorded the broadest interpretation as with the above term "print", and implies any liquid which could be provided for the forming of images, designs, patterns, and so forth on a recording medium, for processing a print medium with regard to such images, designs, patterns, and so forth, and for processing ink (e.g., coagulation or non-solvency of color material within ink provided to a printing medium).

In the embodiments described below, a printer will be given as an example of a recording apparatus using the inkjet recording method.

I Basic Configuration

First, the basic configuration of the printer will be described with reference to FIGS. 1 through 18.

I 1 Apparatus Main Unit

Figure 1:
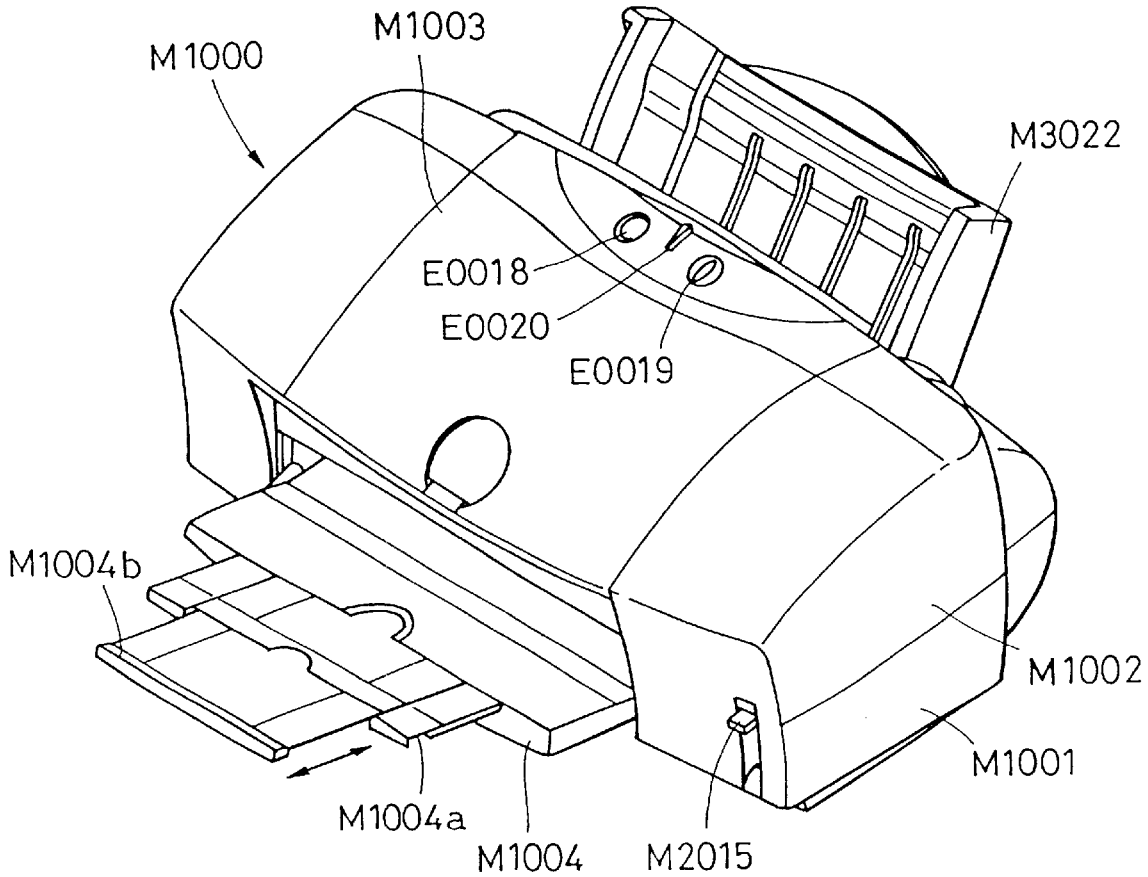
FIG. 1 is a perspective diagram illustrating the external configuration of an ink-jet printer according to an embodiment of the present invention.
Figure 2:
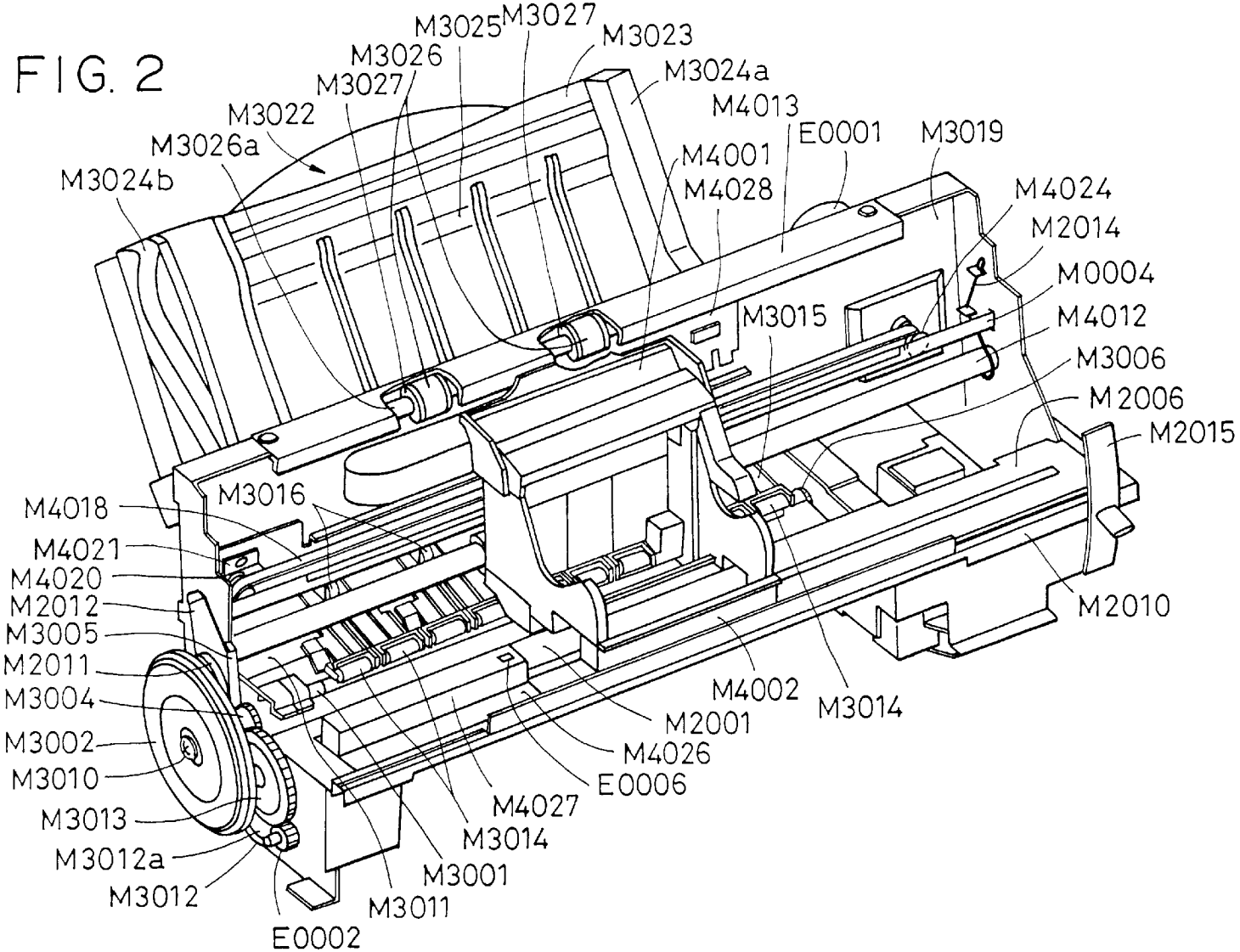
FIG. 2 is a perspective is a perspective view of the printer shown in FIG. 1 in the state of the housing members removed.

FIGS. 1 and 2 schematically illustrate the configuration of the printer using the ink-jet recording method. In FIG. 1, the outer shell of the apparatus main unit M1000 of the printer according to the present embodiment comprises the housing members of a lower case M1001, an upper case M1002, an access cover M1003, and a sheet discharge tray M1004, and a chassis M3019 (see FIG. 2) stored within the housing members.

The chassis M3019 is configured of multiple plate-shaped metal members having a predetermined amount of rigidity, making up the skeleton of the recording apparatus, and holding the later-described recording operation mechanisms.

Also, the lower case M1001 and the upper case M1002 each respectively make up the general lower half portion and the general upper half portion of the shell of the apparatus main unit M1000, and the combining of both cases defines a hollow structure having storage space therein for storing the later-described mechanisms. There are openings on the upper face and front face of the apparatus main unit M1000.

Further, one end of the sheet discharge tray M1004 is rotatably supported by the lower case M1001, so as to open and close the opening formed to the front face of the lower case M1001 by the rotation thereof. Accordingly, at the time of executing recording actions, rotating the sheet discharge tray M1004 forwards so as to open the opening enables recording sheets to be discharged from the opening, and also enables the discharged recording sheets P to be sequentially stacked thereupon. Also, two auxiliary trays M1004*a* and M1004*b* are stored in the sheet discharge tray M1004, and pulling the trays toward the user as necessary allows the sheet supporting area to be enlarged or reduced in three stages.

The access cover M1003 is rotatably held at one end by the upper case M1002, so as to open and close the opening formed on the upper face, and opening the access cover M1003 allows the recording head cartridge H1000 or ink tank H1900 or the like stored within the apparatus main unit to be replaced. Incidentally although not shown in the figures in particular, rotating to open and close the access cover M1003 causes a protrusion formed on the reverse side thereof to rotate a cover opening/closing lever, and the open/closed state of the access cover can be detected by detecting the rotational position of the lever with a micro-switch or the like.

Also, an electric power source key E0018 and a resume key E0019 which can be pressed are provided on the upper portion at the back of the upper case M1002, along with an LED E0020, such that pressing the electric power source key E0018 causes the LED E0020 to turn on, notifying the operator that the apparatus is available for recording. The LED E0020 has various display functions of indicating printer trouble or the like to the operator by blinking and/or changing colors, and a buzzer E0021 (see FIG. 15) is also used in conjunction to this end. Once the trouble or the like is solved, pressing the resume key E0019 resumes recording.

I 2 Recording Action Mechanism

Next, description will be made regarding the recording action mechanism according to the present invention which is stored and held in the printer apparatus main unit M1000.

The recording action mechanism of the present embodiment is made up of an automatic feeding unit M3022 which automatically feeds recording sheets into the apparatus main unit, a transporting unit M3029 which leads the recording sheets fed one sheet at a time from the automatic feeding unit to a desired recording position, and also leads the recording sheets P from the recording position to a discharge unit M3030, a recording unit M4000 for performing desired recording on the recording sheets transported to the recording position, and a recovery unit M5000 for performing recovery processing on the above recording unit M4000 and so forth.

Next, the configuration of each mechanism unit will be described.

I 2.1 Automatic Feeding Unit

First, the automatic feeding unit M3022 will be described with reference to FIGS. 2 and 3.

The automatic feeding unit M3022 according to the present embodiment is arranged so as to feed, in a horizontal manner, recording sheets stacked at an angle of 30° or 60° as to a horizontal plane, and discharge the recording sheets into the apparatus main unit from a supplying opening not shown in the drawings while maintaining a generally horizontal state.

That is, the automatic feeding unit M3022 has a feeding roller M3026, sheet guides M3024*a* and M3024*b*, a pressing plate M3025, an ASF base M3023, a separating sheet M3027, separating claws not shown in the figure, and so forth. Of these, the ASF base M3023 forms the shell for the automatic feeding unit M3022, and is provided at the rear side of the apparatus main unit. Also provided at the front side of the ASF is the pressure plate M3025 which holds the recording sheets, being attached at an angle of approximately 30° or 60° as to a horizontal plane, and having a pair of sheet guides M3024*a* and M3024*b* erected thereupon for guiding both ends of the recording sheets. One sheet guide M3024*b* is movable in the width direction of the sheet, so as to handle various sizes (widths) of recording sheets in the horizontal direction.

Also, a driving shaft M3026*a* is rotatably provided to both left and right sides of the ASF base M3023 so as to move synchronously with a PG motor via a transmitting gear not shown in the drawings, and the driving shaft M3026*a* has multiple feeding rollers M3026 having generally half-moon-shaped cross-sectional forms fixed thereto.

Figure 15:
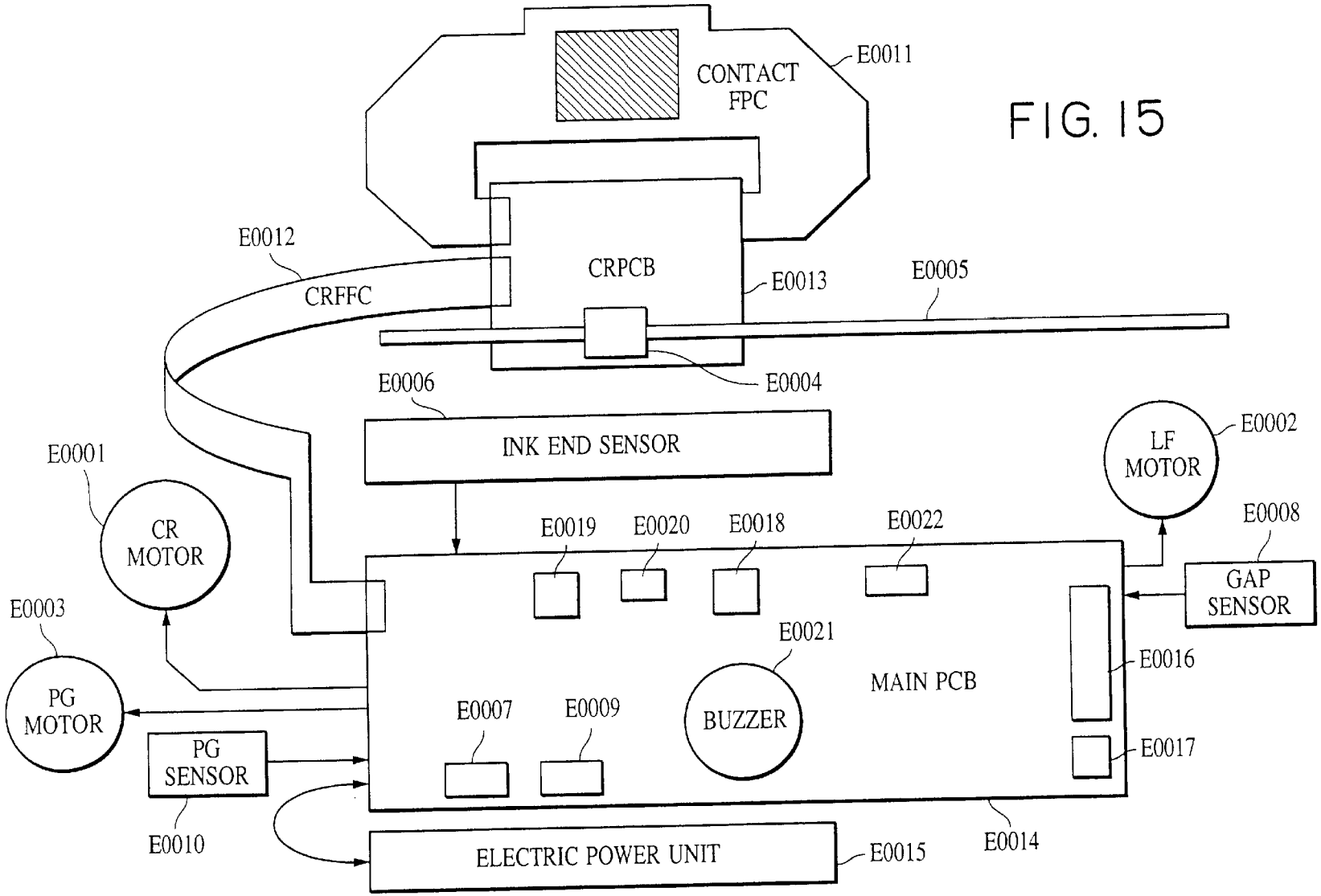
FIG. 15 is a block diagram schematically illustrating the entire configuration of the electro circuits on the printer according to an embodiment of the present invention.

The recording sheets P loaded on the pressure plate M3025 are fed out by the feeding roller M3026 rotating synchronously by the driving of the PG motor E0003 (shown in FIG. 15). Now, the top-most recording sheet on the stack of recording sheets P stacked on the pressure plate M3025 is sequentially separated by the separating sheet M3027 and the separating claws, one sheet at a time, and transported to the transporting unit M3029. The lower side of the pressure plate M3025 is elastically supported by a pressure plate spring M3028 introduced between the lower side of the pressure plate M3025 and the ASF base M3023, is the pressing force of the feeding roller and recording sheets can be maintained at a constant regardless of how many recording sheets P are stacked thereupon.

Figure 3:
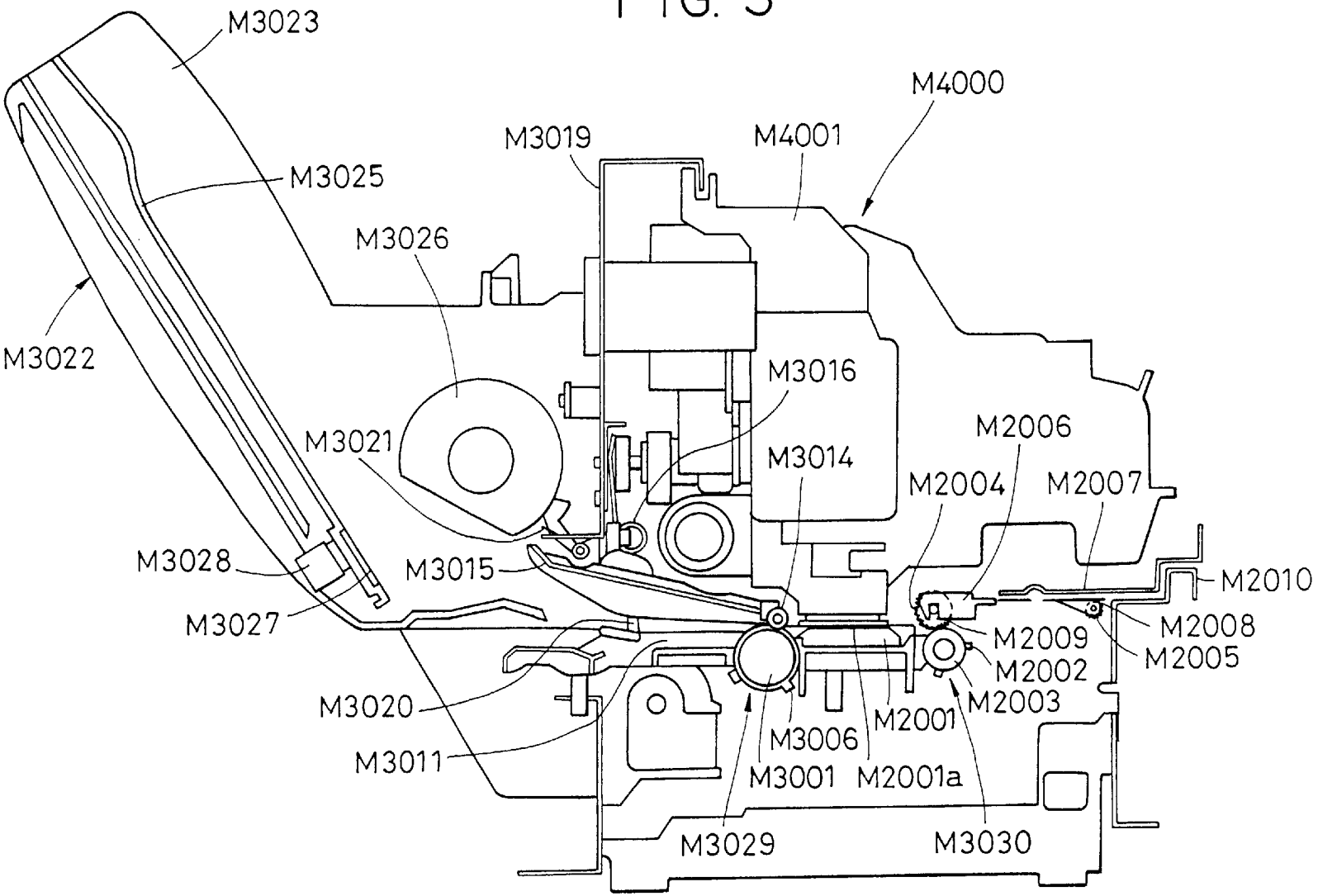
FIG. 3 is a side view of that shown in FIG. 2.

Also, a PE lever M3020 pressed toward the clockwise direction in FIG. 3 by a PE lever spring M3021 is axially fixed to a chassis M3019 formed of metal plate members having a predetermined level of rigidity an fixed to the apparatus main unit M1000, in the transporting path for recording sheets from the automatic feeding unit M3022 to the transporting unit M3029. Passing a recording sheet, separated and transported by the automatic feeding unit M3022, through the recording sheet path causes one end thereof to press one end of the lever so as to cause the lever to rotate, whereby a PE sensor not shown in the drawings detects the rotation of the PE lever M3020, and the fact that a recording sheet has entered the transporting path is detected.

Following detection of the recording sheet entering into the transporting path, the recording sheet is transported downstream by the feeding roller M3026 by a predetermined distance. The transporting action by this feeding roller M3026 stops in a state of the recording sheet P looped approximately 3 mm following the edge of the recording sheet abutting against the nipping portion between a stopped later-described LF roller M3001 and pinch roller M3014 provided to the transporting unit.

I 2.2 Transporting Unit

Figure 4:
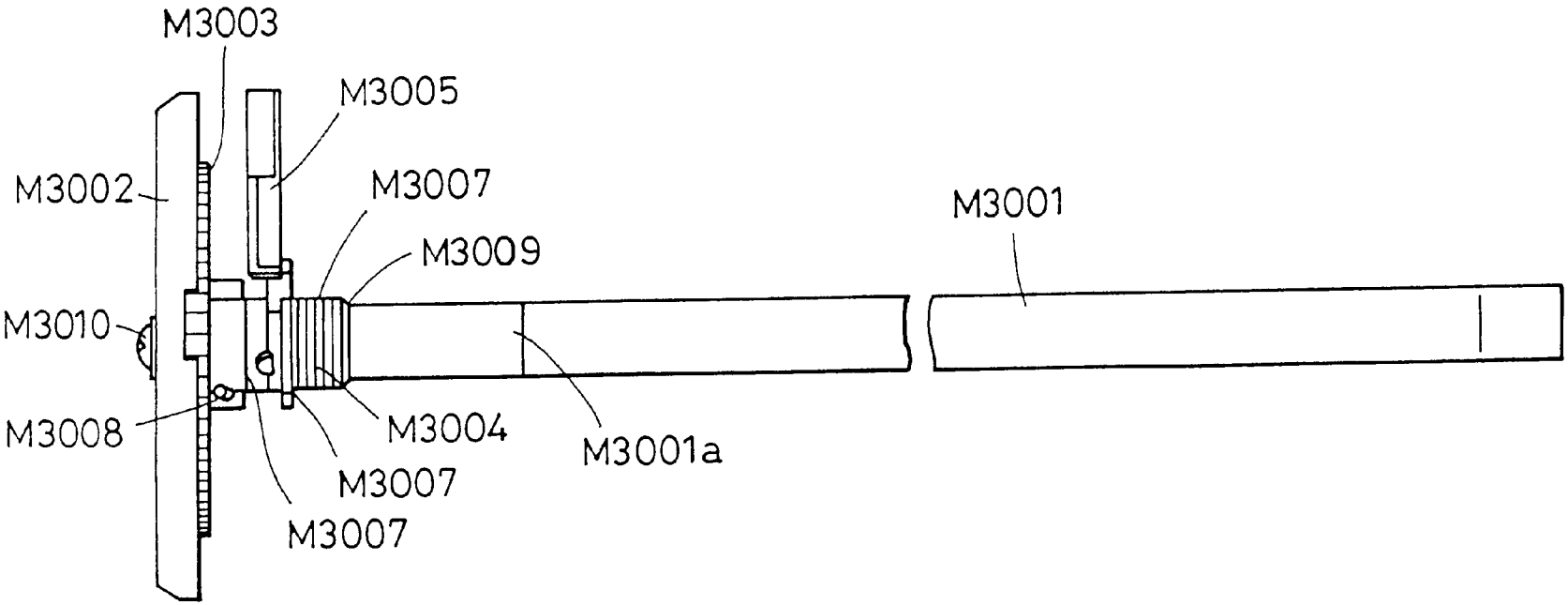
FIG. 4 is a frontal view illustrating a sheet feeding roller and LF gear cover and the like shown in FIG. 2.
Figure 5:
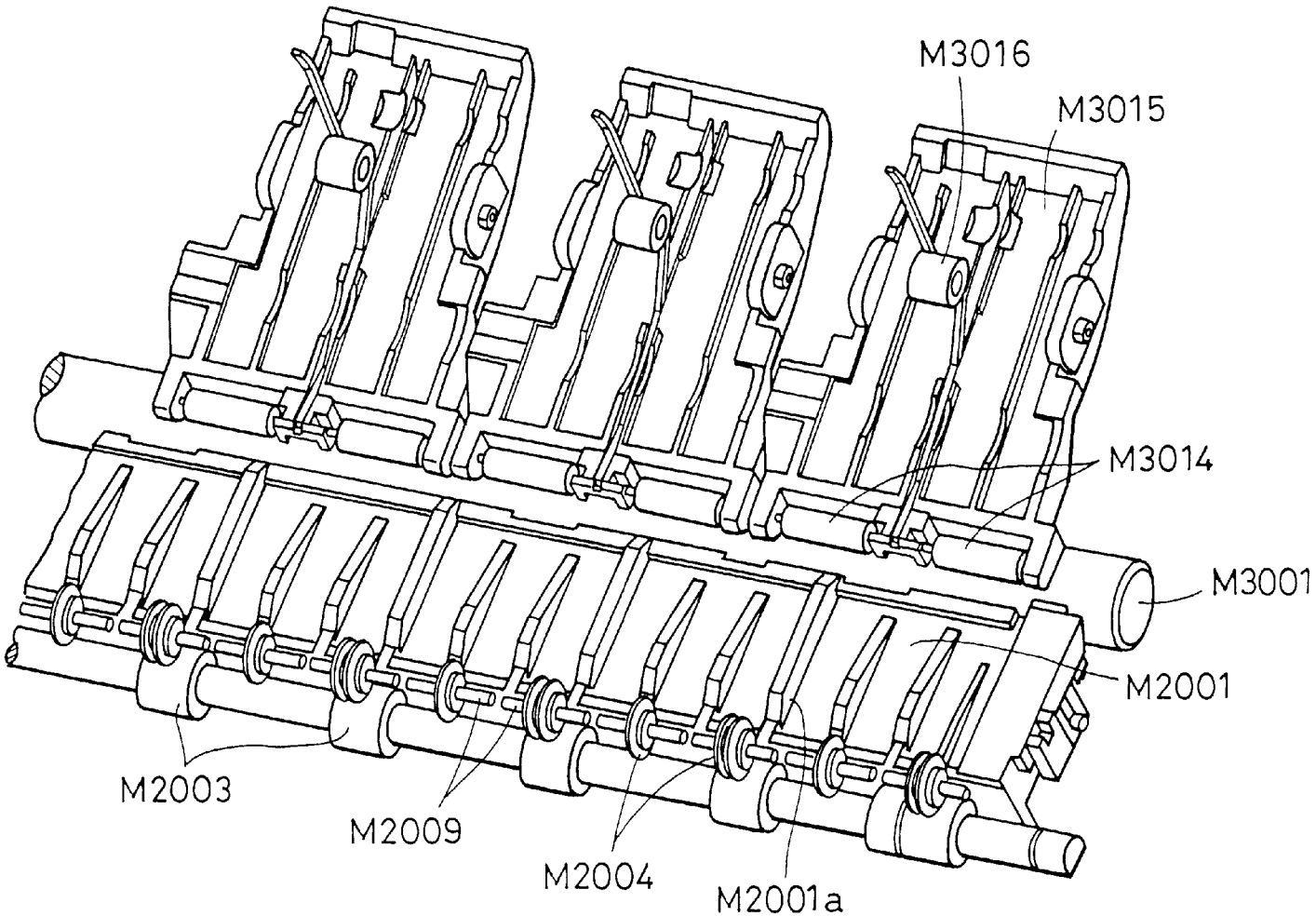
FIG. 5 is a perspective view illustrating a pinch roller and the like shown in FIG. 2.

The transporting unit M3029 comprises an LF roller M3001, pinch roller M3014, platen M2001, and so forth. The LF roller M3001 is fixed to a driving shaft rotatably supported by the chassis M3019 and so forth, with an LF gear cover M3002 mounted to one end thereof as shown in FIG. 4, so that the LF gear M3003 fixed to the driving shaft M3001*a* and a small gear M3012*a* (see FIG. 2) of an LF intermediate gear M3012 meshing with the LF gear M3003 can be simultaneously protected. The LF intermediate gear M3012 moves synchronously with a driving gear provided on the driving shaft of a later-described LF motor E0002, and rotates from the driving force of this motor.

Also, the pinch roller M3014 is axially mounted to the tip portion of a pinch roller holder M3015 rotatably supported by the chassis M3019, and is pressed against the LE roller M3001 by a coil-spring-shaped pinch roller spring M3016 for pressing the pinch roller holder M3015. Accordingly, the pinch roller M3014 rotates in a manner following the rotation of the LF roller M3001, and transports the recording sheet P, which has stopped in a loop form as described above, forwards while holding between the pinch roller M3014 and the LF roller M3001.

Also, the rotational center of the pinch roller M3014 is offset approximately 2 mm downstream in the transporting direction from the rotational center of the LF roller M3001. Accordingly, the recording sheets transported by the LF roller M3001 and the pinch roller M3014 are transported in a direction toward the lower right in FIG. 3, and the recording sheets are transported along a recording sheet supporting face M2001*a* (see FIG. 5) of the platen M2001.

With a transporting unit thus configured, following stopping of the transporting action by the feeding roller M3026 of the automatic feeding unit M3022, driving of the LF motor E0002 starts again following passage of a certain amount of time, the driving of the LF motor E0002 is transmitted to the LF roller M3001 via the LF intermediate gear M3012 and the LF gear M3003, so that the recording sheet P with the leading edge thereof abutted against the nipping portion of the LF roller M3001 and the pinch roller M3014 is transported to the recording starting position on the platen M2001 by the rotation of the LF roller M3001.

At this time, the feeding roller M3026 starts rotating again simultaneously with the FL roller M3001, so the recording sheet is transported downstream by the cooperating action of the feeding roller M3026 and the LF roller M3001 for a predetermined amount of time.

The latter-described recording head cartridge H1000 moves due to being mounted on a carriage M4001 which reciprocally moves in a direction orthogonal to the transporting direction of the recording sheets P (i.e., in the scanning direction), along a carriage shaft M4012 fixed to the chassis M3019 at both edges thereof, and discharges ink onto the recording sheet standing by at the recording start position, thereby recording images based on predetermined image information.

Following recording of the image, the LF roller M3001 rotates by a certain amount to transport the recording sheet P by line increments of, e.g., 5.42 mm in transporting distance, and following the transporting action, the carriage M4001 performs main scanning along the carriage shaft M4012, this action is repeatedly performed, and images are recorded on the recording sheet P positioned on the platen M2001.

Also, the carriage shaft M4012 is mounted at one end to an adjusting plate not shown in the drawings, via an adjusting lever M2015, and the other end is mounted to another adjusting plate M2012 via a carriage shaft cam M2011, being pressed via a carriage shaft spring M2014. The adjusting plate M2012 and the other unshown adjusting plate are each fixed to the chassis M3019 such that the distance between the discharging face of the recording head cartridge H1000 and the recording supporting face M2001*a* of the platen M2001 can be adjusted to an appropriate distance.

Further, the adjusting lever M2015 is capable of selectively being set by an adjusting lever spring not shown in the drawings to two stopping positions, one at the top position as shown in FIG. 1, and the other at a bottom position now shown in the drawings, and in the event that the adjusting lever M2015 is moved to the bottom position, the carriage M4001 moves away from the platen M2001 by approximately 0.6 mm, for example. Accordingly, in the event that the recording sheet P is thick, such as an envelope, the adjusting lever M2015 is moved to the bottom position beforehand, and then sheet feeding operation is started with the automatic feeding unit M3022.

Also, in the event that the sheet gap adjusting lever M2015 is in the bottom position, a GAP sensor E0008 (see FIG. 15) has detected that state. Accordingly, at the time of the sheet feeding action being started upon the recording sheets by the automatic feeding unit M3022, judgment is made whether or not the position of the adjusting lever M2015 is appropriate or not, and in the event that an inappropriate state is detected, a warning is issued by displaying a message or operating a buzzer or the like, thereby preventing beforehand recording actions being executed in such an inappropriate state.

I 3 Sheet Discharging Unit

The sheet discharging unit M3030 will next be described with reference to FIGS. 2 and 3.

As shown in FIG. 3, the discharging unit M3030 comprises a discharging roller M2003, a discharging gear M3013 mounted to this discharging roller M2003 for transporting to driving of the LF motor E0002 to the discharging roller M2003 via the LF intermediate gear M3012, a first spur M2004 which rotates following the rotation of the discharging roller M2003 and transports the recording sheets by holding the recording sheets between the first spur M2004 and the discharging roller M2003, a discharging tray M1004 which aids in discharging of the recording sheets P, and so forth. The first spur M2004 is pressed against the discharging roller M2003 by the pressing force of a spur spring shaft M2009 attached to a first spur holder M2007 mounted to a spur stay M2006.

The recording sheets transported to this discharging unit M3030 are subjected to transporting force by the discharging roller M2030 and the first spur M2004, but the center of rotation of the first spur M2004 is offset so as to be approximately 2 mm upstream in the transporting direction as compared to the center of rotation of the discharging roller M2003. Accordingly, the recording sheets transported by the discharging roller M2003 and the first spur M2004 come into slight contact with the recording sheet supporting face M2001*a* of the platen M2001 without having a gap therebetween, so the recording sheets are transported properly and smoothly.

Further, the transporting speed of the discharging roller M2003 and the first spur M2004 is approximately the same as the transporting speed of the LF roller M3001 and pinch roller M3014, but the transporting speed of the discharging roller M2003 and the first spur M2004 is slightly faster, to prevent slack in the recording sheets P.

Further, the spur stay M2006 holds a second spur M2005 mounted to a second spur holder M2008 at one part at the downstream side of the first spur M2004, thereby preventing the recording sheets from rubbing against the spur stay M2006.

Once the recording of the image onto the recording sheet P is completed and the trailing edge of the recording sheet departs from between the LF roller M3001 and the pinch roller M3014, transporting of the recording sheet is performed only by the discharging roller M2003 and the first spur M2004, thereby completing discharging of the recording sheet P.

I 4 Recording Unit

Next, description will be made of the recording unit M4000, which comprises a carriage M4001 movably supported by a carriage shaft M4021, and a recording head cartridge H1000 detachably mounted to this carriage M4001.

I 4.1 Recording Head Cartridge

First, description will be made regarding the recording head cartridge used with recording unit, based on FIGS. 6 and 8.

Figure 6:
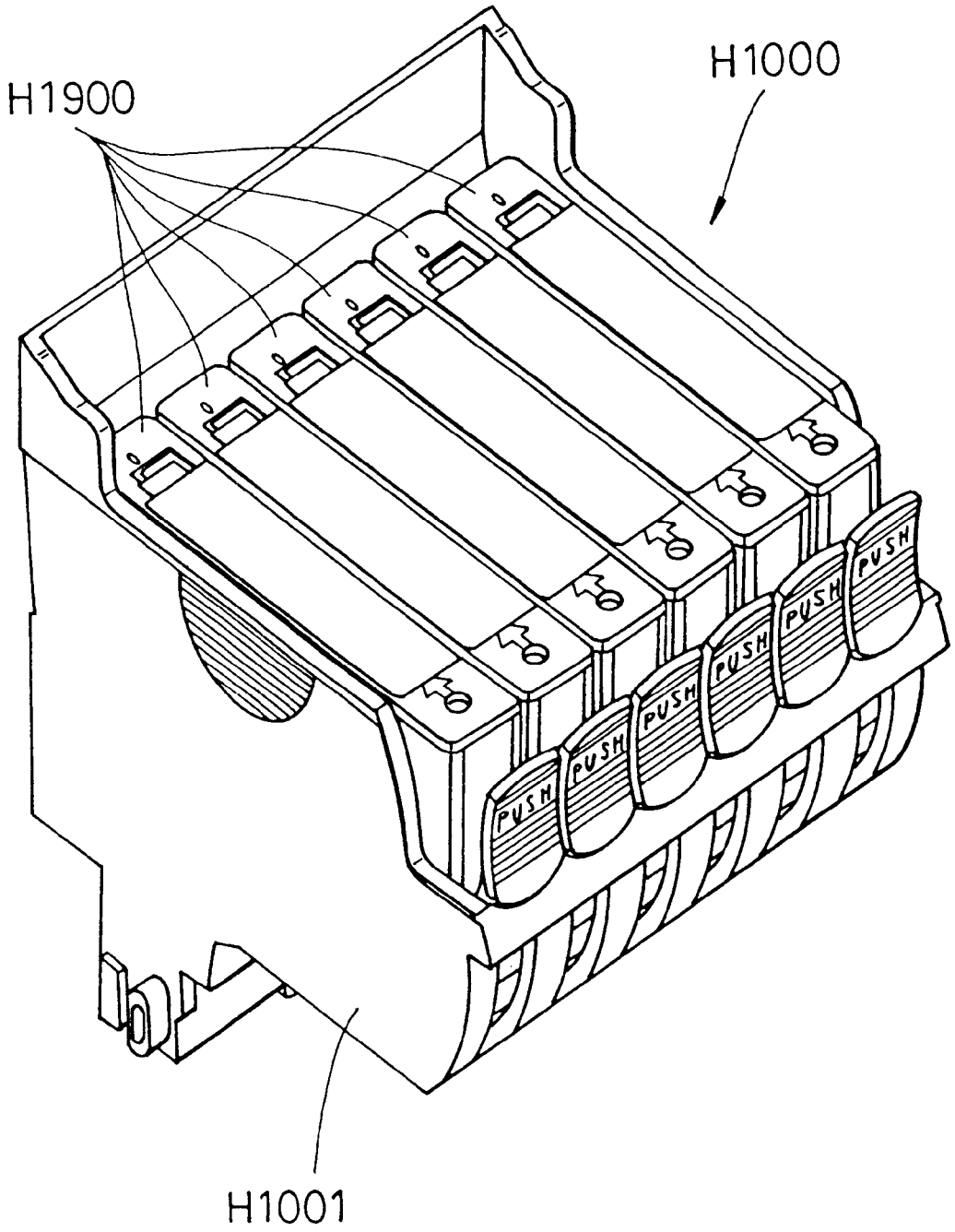
FIG. 6 is a perspective view illustrating a recording head cartridge used with the printer according to an embodiment of the present invention.

The recording head cartridge H1000 according to the present embodiment comprises an ink tank H1900 for storing ink, as shown in FIG. 6, and a recording head H1001 for discharging from nozzles ink supplied from the ink tank H1900 according to recording information. The recording head H1001 is a so-called cartridge type which is detachably mounted to the later-described carriage M4001.

Figure 7:
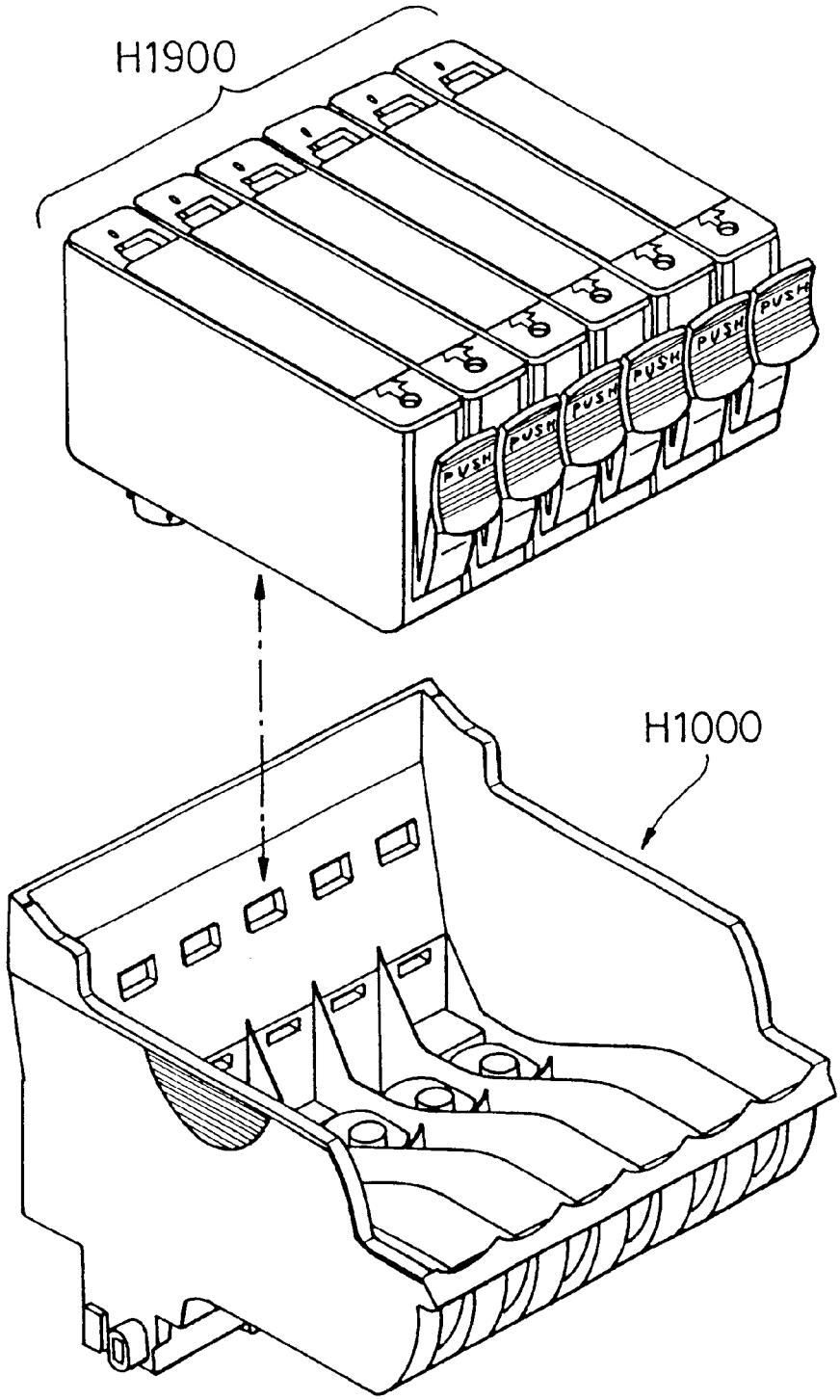
FIG. 7 is a perspective view illustrating the recording head cartridge shown in FIG. 6 in the assembled state.

With the recording head cartridge H1000 illustrated head, ink tanks H1900 for each of the colors black, light cyan, light magenta, cyan, magenta, and yellow, are provided as ink tanks to realizing high-quality color recording of photograph quality. As shown in FIG. 7, each of the ink tanks H1900 are detachably mounted to the recording head H1001.

Figure 8:
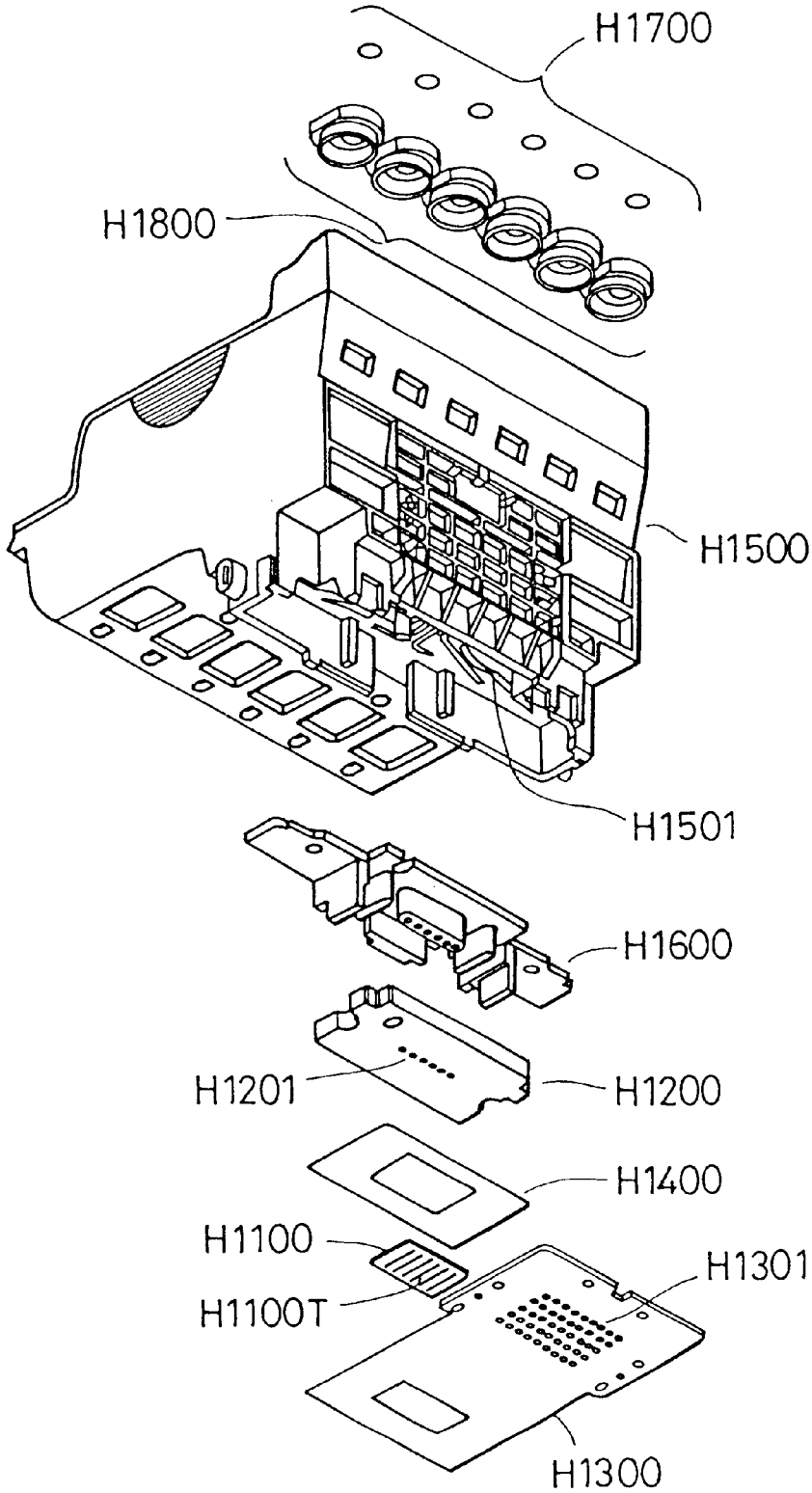
FIG. 8 is a perspective view illustrating the recording head shown in FIG. 7 from the lower side at an angle.

As shown in the disassembled perspective view shown in FIG. 8, the recording head H1001 comprises a recording element substrate H1100, a first plate H1200, an electric wiring board H1300, a second plate H1400, a tank holder H1500, a channel forming member H1600, filters 1700, and sealing rubber H1800.

For the recording element substrate H1100, multiple recording elements for discharging ink and electric wiring such as Al or the like for supplying electric power to the recording elements are formed on one side of an Si substrate by a film forming technique, with multiple ink channels corresponding to the recording elements and multiple discharging orifices H1100T being formed by photolithography, and ink supplying openings for supplying ink to the multiple ink channels are opened to the rear side. Also, the recording element substrate H1100 is fixed to a first plate H1200 by an adhesive agent, and ink supplying openings H1201 for supplying ink to the recording element substrate H1100 are formed here. Further, a second plate H1400 having an opening is fixed by an adhesive agent onto the first plate H1200, and the second plate H1400 has an electric wiring board H1300 wherein the electric wiring board H1300 and the recording element substrate H1100 are electrically connected. The electric wiring board H1300 is for applying electric signals for discharging ink to the recording element substrate H1100. The electric wiring board H1300 comprises electric lines corresponding to the recording element substrate H1100, and an external signal input terminal H1301 positioned at the electric wiring ends for receiving electric signals from the apparatus main unit, wherein the external signal input terminal H1301 is positioned and fixed to the rear side of a layer-described tank holder H1500.

On the other hand, the tank holder H1500 which detachably holds the ink tanks H1900 us fixed to the channel forming member H1600 by ultrasonic fusing for example, thereby forming ink channels H1501 from the ink tanks H1900 to the first plate H1200. Also, filters H1700 are formed on the ink tank side end portion of the ink channels H1501 engaging the ink tanks H1900, so as to prevent dust intruding from external sources. Also, sealing rubber H1800 is mounted at the engaging portion with the ink tanks H1900, so as to prevent ink form evaporating from the engaging portion.

Further, the recording head H1001 is configured by joining the tank holder unit configured of the tank holder H1500, channel forming member H1600, filters H1700, and sealing rubber H1800, with the recording element unit configured of a recording element substrate H1100, a first plate H1200, electric wiring board H1300, and second plate H1400, using an adhesive agent or the like.

I 4.2 Carriage

Figure 9:
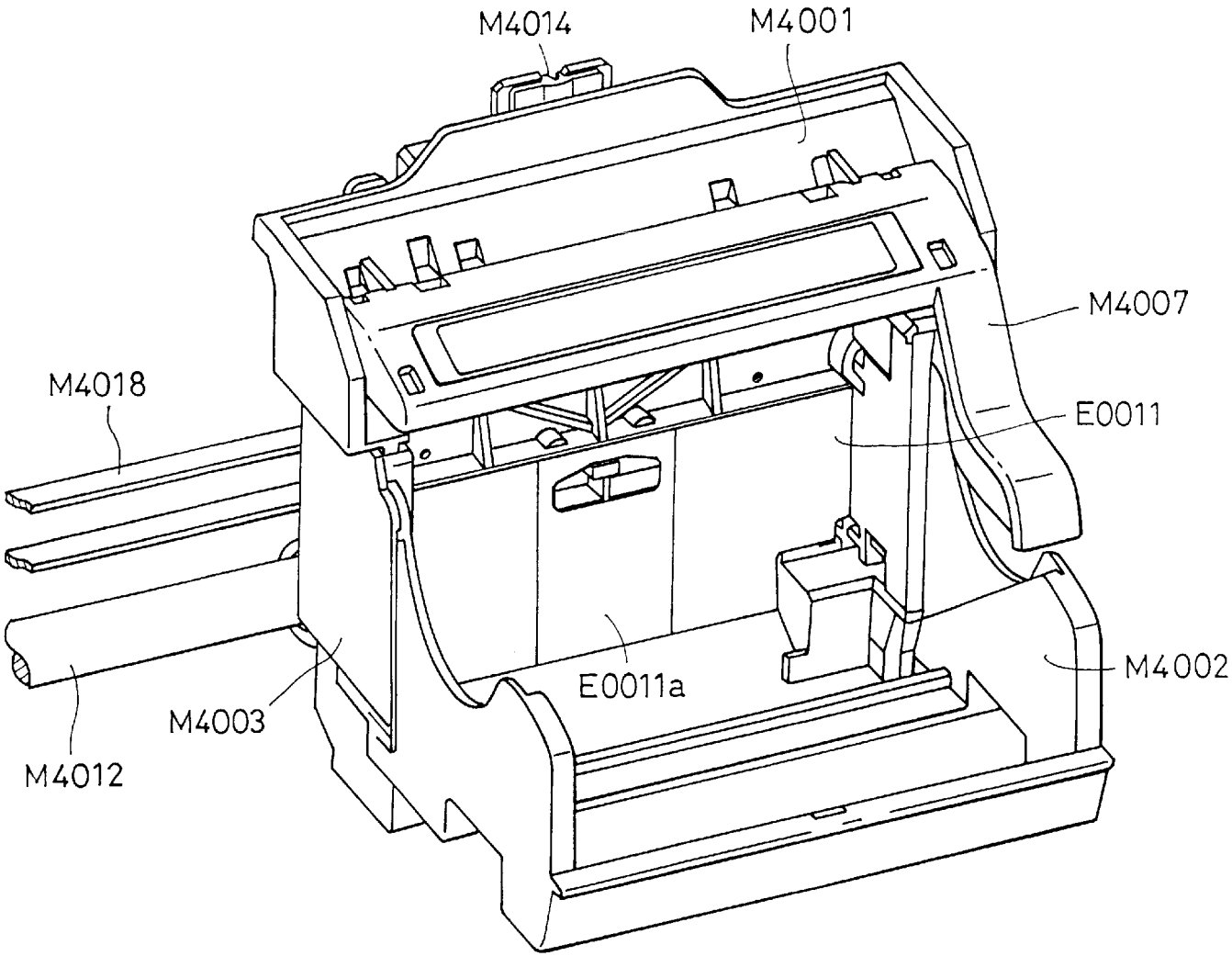
FIG. 9 is a perspective view illustrating the front side of a carriage used with an embodiment of the present invention.

Next, the carriage M4001 upon which is mounted the recording head cartridge H1000 will be described with reference to FIGS. 2, 9, and 10.

As shown in the drawings, provided on the carriage M4001 is a carriage cover M4002 for engaging with the carriage M4001 and guiding the recording head H1001 to the mounting position with the carriage M4001, and a head setting lever M4007 for engaging with the tank holder H1500 of the recording head H1001 and presses the recording head H1001 so as to be set in its predetermined mounting position.

That is, the head setting lever M4007 is provided rotatably as to a head setting lever shaft M4008 above the carriage M4001, an unshown head setting plate is provided at the portion of engaging with the recording head H1001 via a spring, and the recording head 1001 is mounted to the carriage M4001 by the pressing force of this spring.

Also, a contact flexible print cable (hereafter referred to simply as "contact FPC") E0011 is provided at an engaging portion of the carriage M4001 other than that with the recording head H1001, so that a contact portion E0011*a* on the contact FPC E0011 makes electrical contact with a contact part (external signal input terminal) H1301 provided to the recording head H1001, thereby allowing various types of information for recording to be exchange, electric power to be supplied to the recording head H1001, and so forth.

Now, an elastic material such as rubber or the like not shown in the drawings is provided between the contact portion E0011*a* of the contact FPC E0011 and the carriage M4001, such that contact between the contact portion E0011*a* and the carriage M4001 can be made in a sure manner due to the elastic force of this elastic material and the pressing force of the head setting lever spring. Further, the contact E0011 is extended to both side faces of the carriage M4001, such that a pair of FPC pressers M4003 and M4006 hold and fix both end portions thereof at the side face portions of the carriage M4001 as shown in FIGS. 9 and 10, thereby making connection to the carriage substrate E0013 mounted on the rear side of the carriage M4001 (see FIG. 10).

Figure 10:
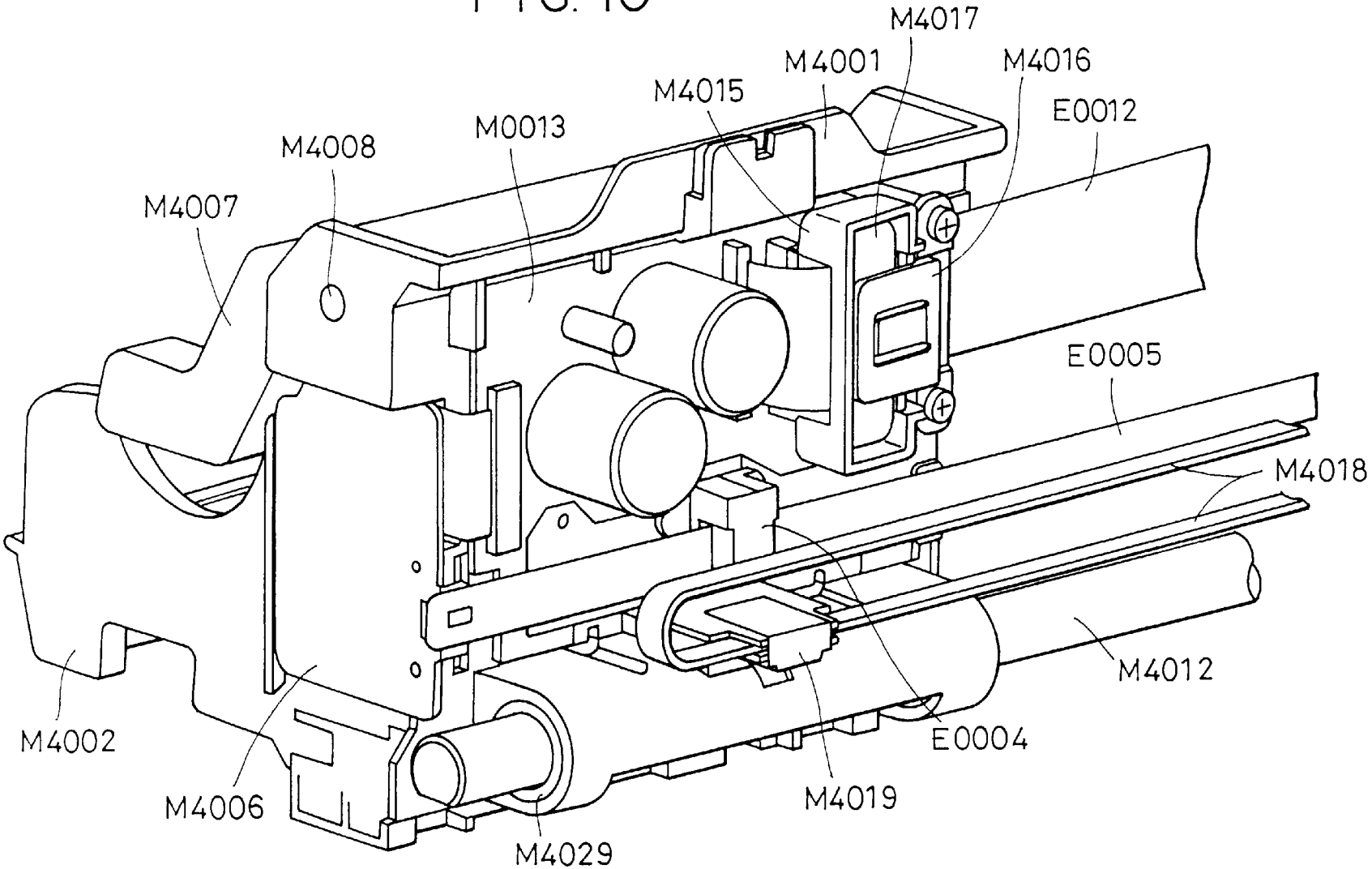
FIG. 10 is a perspective view illustrating the rear side of the carriage shown in FIG. 9.

Also, as shown in FIG. 10, the carriage substrate E0013 is electrically connected to a described main board E0014 (see FIG. 15) provided to the chassis M3019 and a carriage flexible flat cable (hereafter referred to as "carriage FFC") E0012. Also, as shown in FIG. 10, a pair of flexible flat cable pressers (FFC pressers) M4015 and M4016 are provided at the joining portion between one end of the carriage FFC E0014 and the carriage substrate E0013 to serve as pressing members, so that the carriage FFC E0014 is fixedly disposed to the carriage substrate E0013 (see FIG. 15). Further, a ferrite core M4017 is provided to shield electromagnetic waves radiating from the carriage FFC E0012 and the like.

Also, the other end of the carriage FFC E0012 is fixed to the chassis M3019 (FIG. 2) by an FFC presser M4028 (FIG. 2), and is extended out from the rear side of the chassis M3019 via a hole formed in the chassis M3019 but not shown in the drawings, and thus connected to the main board E0014 (FIG. 15).

As shown in FIG. 10, an encoder sensor E0004 is provided to the carriage substrate E0013, to detect the position, scanning speed, etc., of the carriage M4001, by detecting information on an encoder scale E0005 strung between both sides of the chassis M3019 in a manner parallel to the carriage shaft M4012. In the case of the present embodiment, the encoder sensor E0004 is an optical transmitting sensor, and the encoder scale E0005 is formed by alternately printing light shielding portions for shielding detection light from the encoder sensor and transmitting portions for transmitting detection light at a predetermined pitch on a resin film such as polyester or the like, using photolithography or a like technique.

Accordingly, the position of the carriage M4001 moving along the carriage shaft M4012 can be detected at all times by abutting the carriage M4001 against one side plate of the chassis M3019 provided at the end of the scanning track of the carriage M4001, and with that abutting position as a reference, counting the number of patterns formed on the encoder scale E0005 with the encoder sensor E0004 during subsequent scanning of the carriage M4001.

Also, the carriage M4001 is configured so as to scan being guided along a carriage shaft M4012 suspended between both sides of the chassis M3019, and a carriage rail M4013, and a pair of carriage bearings M4029 formed by impregnating sintered metal or the like with a lubricating agent such as oil or the like integrally with the carriage shaft M4012 by insertion forming or the like. Further, a carriage slider (CR slider) M4014 which is a contact material formed of resin or the like with excellent slidability and wear resistance is provided at the point of contact between the carriage M4001 and the carriage rail M4013 so as to allow smooth scanning of the carriage M4001 as with the above CR bearings M4029.

Also, the carriage M4001 is fixed to a carriage belt M4018 hung between an idler pulley M4020 (FIG. 2) and a carriage motor pulley M 4024 (FIG. 2) in a manner generally parallel to the carriage shaft, such that the carriage motor pulley M4024 is moved by driving of the carriage motor E0001 (FIG. 15) and the carriage belt M4018 is moved in the forward direction or return direction, thereby scanning the carriage M4001 along the carriage shaft M4012. Also, although the carriage motor pulley M4024 is held in a set position by the chassis, the idler pulley M4020 is movably held as to the pulley holder M4021 and the chassis M3019 and is pressed by the spring in the direction away from the motor pulley M4024, so that there is always an appropriate degree of tension applied to the carriage belt M4018 hung between the pulleys M4020 and M4024, thus maintaining a suitable state of suspension with no slack.

Incidentally, a carriage belt stopper M4019 is provided at the point on the carriage belt M4018 where the carriage M4001 is attached, thereby securely attaching the carriage M4001 thereto.

Also, an ink-empty sensor E0006 (FIG. 2) for detecting the amount of remaining ink stored in the ink tanks H1900 of the recording head cartridge H1000 mounted in the carriage M4001 is provided on the scanning track of the carriage M4001 on the spur stay M2006, so as to face the ink tanks H1900 in an exposed manner. The ink-empty sensor E0006 is held by an ink-empty sensor holder M4026, and is stored within an ink-empty sensor cover M4027 having metal plates and the like for preventing erroneous action and so forth of the sensor, thereby allowing external noise to be shut out.

I 5 Recovery Unit

Next, description will be made regarding the recovery unit which performs recovery processing for the recording head cartridge H1000, with reference to FIGS. 11 and 12.

The recovery unit according to the present embodiment is configured of a recovery system unit M5000 which is independently detachable from the apparatus main unit M1000, and this recovery system unit M5000 comprises cleaning means for removing foreign matter adhering to the recording element substrate H1100 of the recording head H1001, and recovery means and the like for normalizing the ink channel leading from the ink tank H1900 to the recording element substrate H1100 of the recording head H1001 (i.e., the channel leading from H1501 through H1501 and H1600 to H1400).

Figure 11:
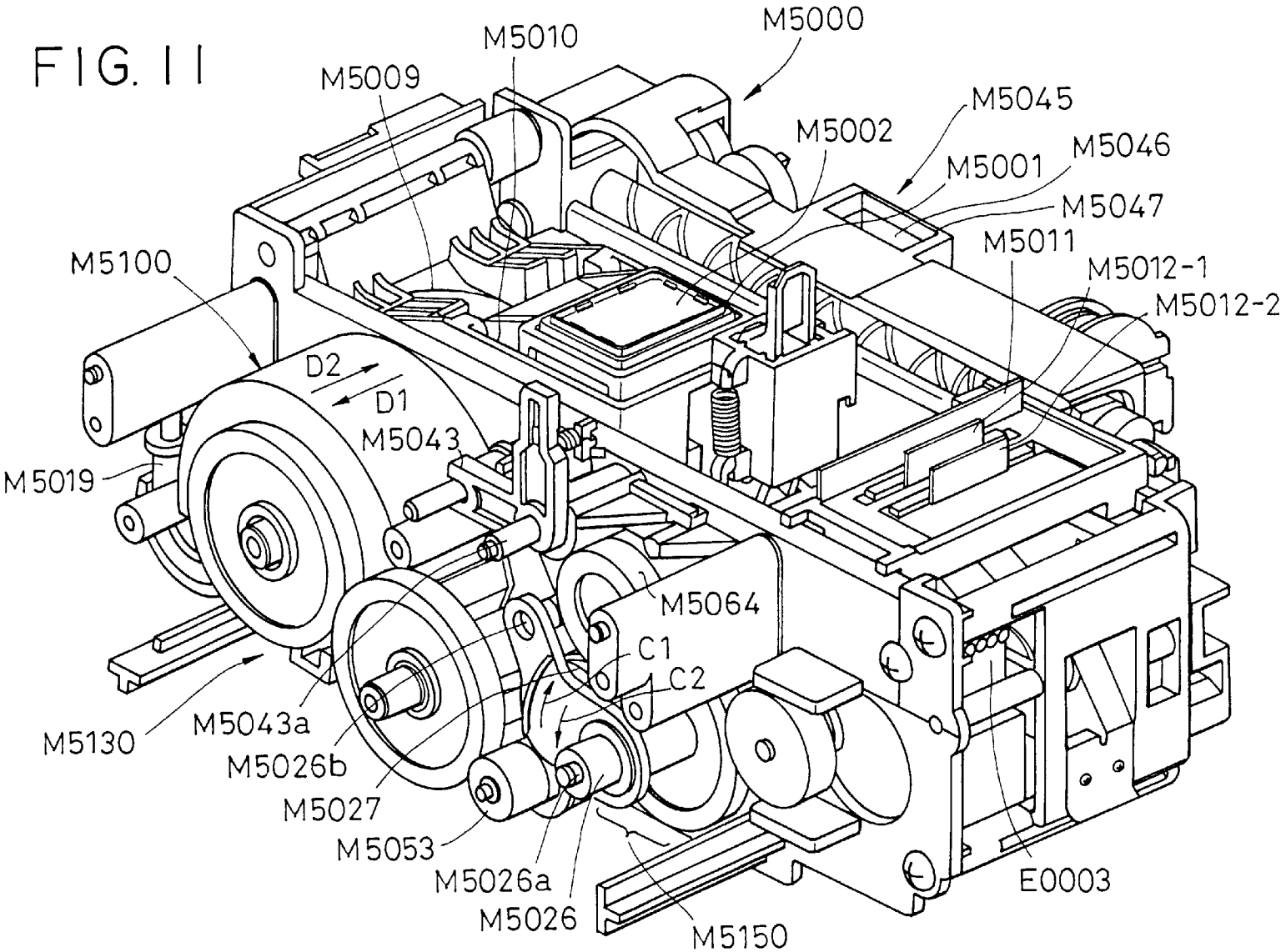
FIG. 11 is a perspective view illustrating a side portion of a recovery system unit according to an embodiment of the present invention.
Figure 12:
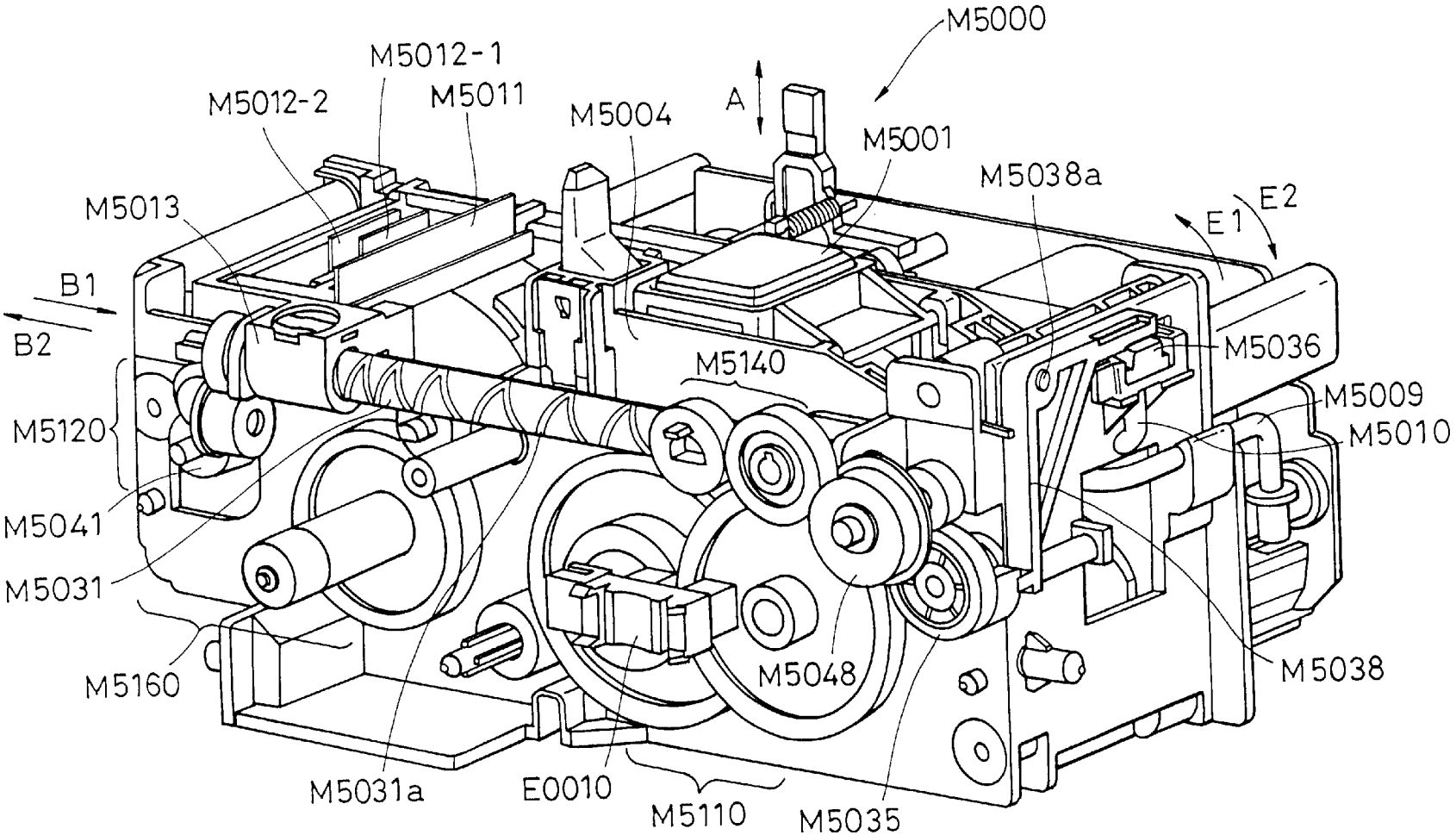
FIG. 12 is a perspective view illustrating another side part of the recovery system unit shown in FIG. 11.

In FIGS. 11 and 12, reference numeral E0003 denotes a PG motor, and serves as a driving source for driving the later-described cap M5001, pump M5100, wiper blades M5011, M5012-1 and M5012-2, and the automatic feeding unit M3022. With this PG motor E0003, driving force is extracted from both sides of the motor shaft, and one side portion drives the pump M5100 or the above-described automatic feeding unit M3022 via later-described driving switching means. The other side portion drives the cap M5001 which, via a one-way clutch M5041, is linked and synchronously moved only in the event that the PG motor E0003 rotates in a certain rotation direction (hereafter, this certain rotation direction will be referred to as "forward rotation", and rotation in the reverse direction will be referred to as "reverse rotation"). This other side portion also drives the wiper blades M5011, and M5012-1 and M5012-2. Accordingly, when the PG motor E0003 is rotating in the reverse direction, the one-way clutch M5041 rotates free and driving force is not transmitted, so the cap M5001 and the wiper blades M5011, and M5012-1 and M5012-2 are not driven.

The cap M5001 is formed of an elastic material such as rubber or the like, with a rotatable cap lever M5004 attached to the center of the shaft. This cap M5001 moves in the direction of the arrow A in FIG. 12, via the one-way clutch M5041, cap driving transmission gear train M5110, cap cam, and cap lever M5004, so as to come into contact with or be distanced from the recording element substrate H1100 of the recording head H1001. The cap M5001 has absorbing material M5002 within, positioned so as to face the recording element substrate H1100 across a predetermined spacing at the time of capping.

Positioning this absorbing member M5002 allows ink from the recording head cartridge H1000 at the time of the suction action to be received thereby, and further to completely discharge the waste ink within the cap M5001 by later-described pneumatic suction to the waste ink absorbing member. Two tubes are connected to the cap M5001, a cap tube M5009 and a valve tube M5010, with the cap tube M5009 connected to a pump tube M5019 of a later-described pump M5100, and the valve tube M5010 to a later-described valve rubber M5036.

Also, the reference numerals M5011, M5012-1, and M5012-2 denote wiper blades formed of a flexible material such as rubber or the like, and the edges thereof are erected on a blade holder M5013 so as to protrude upwards. Also, a lead screw M5031 is inserted through the blade holder M5013, and a protrusion on the blade holder M5013 not shown in the drawings fits movably with a groove formed on the lead screw M5031. Accordingly, the blade holder M5013 rotates following the rotation of the lead screw M5031, thereby reciprocally moving in the direction of the arrows B1 and B2 in FIG. 12 along the lead screw M5031, while the wiper blades M5011, M5012-1, and M5012-2 wipe and clean the recording element substrate H1100 of the recording head cartridge H1000. The lead screw M5031 is connected to the PG motor E0003 via the one-way clutch M5041 and wiper driving transmission gear train M5120.

Reference numeral M5100 denotes a pump which generates pressure by working the pump tube M5019 with a roller (not shown). This pump is connected to the other side portion of the PG motor E0003 via driving switching means for switching the transmitting path of the driving force between the automatic feeding unit M3022 and this pump M5100, and also via the driving switching means and a pump driving transmission gear train M5130. Also, although details will be omitted, a mechanism is provided to this pump M5100 whereby the pressing force on the pump tube M5019 of the roller (not shown) for working the pump tube M5019 can be released, and in the event that the PG motor E0003 rotates forward the pressing force of the pump roller M5018 is released and so the pump tube M5019 is not worked, while in the event that the PG motor E0003 rotates in the reverse direction the pressing force of the roller acts and works the pump tube M5019. Also, one end of the pump tube M5019 is connected to the cap M5001 via the aforementioned cap tube M5009.

The driving switching means comprises a pendulum arm M5026 and a switching lever M5043. The pendulum arm M5026 is configured so as to rotate in the direction of the arrows C1 and C2 in FIG. 11 following the direction of rotation of the PG motor E0003, on a shaft M5026*a*. Also, the switching lever M5043 switches over depending on the position of the carriage M4001. That is, in the event that the carriage moves to above the recovery system unit M5000, the switching lever M5043 partially comes into contact with the carriage M4001, the switching lever M5043 moves in the direction of the arrows D1 and D2 in FIG. 11 following the position of the carriage M4001, so that a locking hole M5026*b* of the pendulum arm M5026 and a locking pin M5043*a* of the switching lever M5043 can engage.

On the other hand, the other end of the valve tube M5010, of which one end is connected to the cap M5001, is connected to the valve rubber M5036. The valve lever M5038 is brought into contact with the discharging roller M2003 (FIG. 5) via a valve cam M5035, valve clutch M5048, and valve driving transmission gear train M5140, and is rotatable in the directions shown by the arrows E1 and E2 on a shaft M5038*a*, following the rotation of the discharging roller M2003. The valve lever M5038 is capable of being positioned in contact with or distanced from the valve rubber M5036 due to this rotation. In the event that the valve lever M5038 is in contact with the valve rubber M5036, the valve is closed, and in the event that the valve lever M5038 is distanced from the valve rubber M5036, the valve is closed.

Incidentally, reference numeral E0010 denotes a PG sensor, and detects the position of the cap M5001.

Next, description will be made regarding the actions of the recovery system unit M5000 having the above configuration.

First, description will be made regarding the driving of the automatic feeding unit M3022.

When the PG motor E0003 rotates in the reverse direction with the carriage M4001 in a standby position not in contact with the switching lever M5043, the pendulum arm M5026 is swung in the direction of the arrow C1 in FIG. 11 via a pendulum driving transmission gear train M5150, and a switching output gear M5027 attached to the pendulum arm M5026 meshes with an ASF gear 1 M5064 situated at one end of the ASF driving transmission gear train M5160. In the event that the PG motor E0003 continues to rotate in the reverse direction in this state, the automatic feeding unit M3022 is driven via the ASF driving transmission gear train M5160. At this time, the one-way clutch M5041 spins free and driving force is not transmitted to the cap M5001, the wiper blades M5011, M5012-1, and M5012-2, so the wiper blades do not operate.

Next, the suctioning action of the pump M5100 will be described.

When the PG motor E0003 rotates in the forward direction with the carriage M4001 in a standby position not in contact with the switching lever M5043, the pendulum arm M5026 is swung in the direction of the arrow C2 via the pendulum driving transmission gear train M5150, and the switching output gear M5027 attached to the pendulum arm M5026 meshes with a pump gear 1 M5053 situated at one end of the pump driving transmission gear train M5130.

Subsequently, the carriage M4001 moving to the capping position (the position wherein the recording element substrate H1100 of the recording head cartridge H1000 faces the cap M5001) causes part of the carriage M4001 to come into contact with the switching lever M5043, moving the switching lever M5043 in the direction D1, so that the locking pin M5043*a* of the switching lever M5043 and the locking hole M5026*b* of the pendulum arm M5026 engage, and consequently, the pendulum arm M5026 is locked in the state of being connected to the pump side.

Now, the discharging roller M2003 is driven in the reverse direction, and the valve lever M5038 rotates in the direction of the arrow E1 so the valve rubber M5036 is in the open state. In this open state, the PG motor E0003 rotates in the forward direction, thus driving the cap M5001 and the wiper blades M5011, M5012-1, and M5012-2, thereby performing capping (an action wherein the cap M5001 comes into close contact with the recording element substrate H1100 of the recording head H1000 so as to cover it). At this time, the pump M5100 operates, but the pressing force of the roller (not shown) against the pump tube M5019 is disengaged, so the roller does not work the pump tube M5019, and there is no pressure generated.

Also, the discharging roller M2003 is driven in the forward direction, and the valve lever M5038 rotates in the direction of the arrow E2 shown in FIG. 12, which closes the valve rubber M5036. Now, the PG motor E0003 rotating in the reverse direction and the roller working the pump tube M5019 by the pressing force thereupon acts to generate negative pressure on the recording element substrate H1100 of the recording head cartridge H1000 via the cap tube M5009 and cap M5001, thereby forcibly suctioning ink no longer suitable for recording, air bubbles, etc., from the discharging orifices of the recording element substrate H1100.

Subsequently, the PG motor E0003 rotates in the reverse direction while the discharging roller M2003 is rotated in the reverse direction, and the valve lever M5038 is rotated in the direction of the arrow E1 shown in FIG. 12, thereby opening the valve rubber M5036. Consequently, the pressure within the pump tube M5019, cap tube M5009, and the cap M5001 becomes that of the ambient atmosphere, so the action of forcibly suctioning from the ink discharging orifices of the recording element substrate H1100 of the recording head cartridge H1000 stops, and at the same time, the ink filling the pump tube M5019, the cap tube M5009, and the cap M5001 is suctioned, and discharged from the other end of the pump tube M5019 to a waste ink absorbing member not shown in the drawings (hereafter, this action will be referred to as "pneumatic suctioning"). Now, when the PG motor E0003 stops, the discharging roller M2003 is driven forward, and the valve lever M5038 is rotated in the direction of the arrow E2 shown in FIG. 12, the valve rubber M5306 is thus closed, and the suctioning operation is completed.

Next, description will be made regarding the wiping action.

In the wiping action, the PG motor E0003 first rotates in the forward direction, and the wiper blades M5011, M5012-1, and M5012-2 move to the wiping start position (a position wherein the wiper blades M5011, M5012-1, and M5012-2 are upstream from the recording head cartridge H1000 in the recording operation, in the state that the cap M5001 is distanced from the recording head cartridge H1000). Next, the carriage M4001 moves to the wiping position (a position wherein the wiper blades M5011, M5012-1, and M5012-2 face the recording element substrate H1100). At this time, the carriage M4001 and the switching lever M5043 are not in contact, and the pendulum arm M5026 is not locked.

Now, the PG motor E0003 rotates in the forward direction, and the wiper blades M5011, M5012-1, and M5012-2 wipe and clean the recording element substrate H1100 of the recording head cartridge H1000 while moving in the direction of the arrow B1 shown in FIG. 12. Further, the recording element substrate H1100 is wiped and cleaned by an unshown wiper blade cleaning means provided downstream of the recording element substrate H1100 of the recording head cartridge H1000 in the recording operation direction, thereby cleaning the unwanted matter adhering to the wiper blades. At this time, the cap M5001 is maintained in the distanced state.

At the point that the wiper blades reach the wiping end position (the end position downstream in the recording operation) the PG motor stops, and the carriage M4001 moves to the wiping standby position (a position out of the moving range of the wiper blades M5011, M5012-1, and M5012-2). Subsequently, the PG motor E0003 rotates in the forward direction, and the wiper blades move to the wiping end position. Also, the cap M5001 is maintained in the separated state at this time as well, and this completes wiping.

Next, preliminary discharging will be described.

In the event that the above-described suctioning operations and wiping operations are performed using a recording head which discharges inks of multiple colors, there is a problem wherein the inks mix.

This is cause by, for example, ink suctioned out from the ink discharging orifices by suctioning intruding into other ink discharging orifices during the suctioning action, or inks of various colors adhering around the ink discharging orifices being pressed into ink discharging orifices of other colors by the wipers at the time of the wiping operation, and in such cases, the initial portion recorded may change is color (also known as "color mixing") at the time of starting the next recording, thereby deteriorating the quality of the image.

In order to prevent such color mixing, ink of an amount equivalent to the ink that has mixed is discharged immediately before recording, which is called preliminary discharging. With the present embodiment, a preliminary discharging outlet M5045 is provided near the cap M5001 as shown in FIG. 11, and immediately before recording the recording element substrate H1100 of the recording head cartridge H1000 is moved to a position facing the preliminary discharging outlet M5045, where the preliminary discharging is performed.

Incidentally, the preliminary discharging outlet M5045 is formed of a preliminary discharging absorbing material M5046 and a preliminary discharging cover M5047, with the preliminary discharging absorbing material M5046 being connected to an unshown waste ink suctioning member.

I 6 Scanner

Figure 13B:
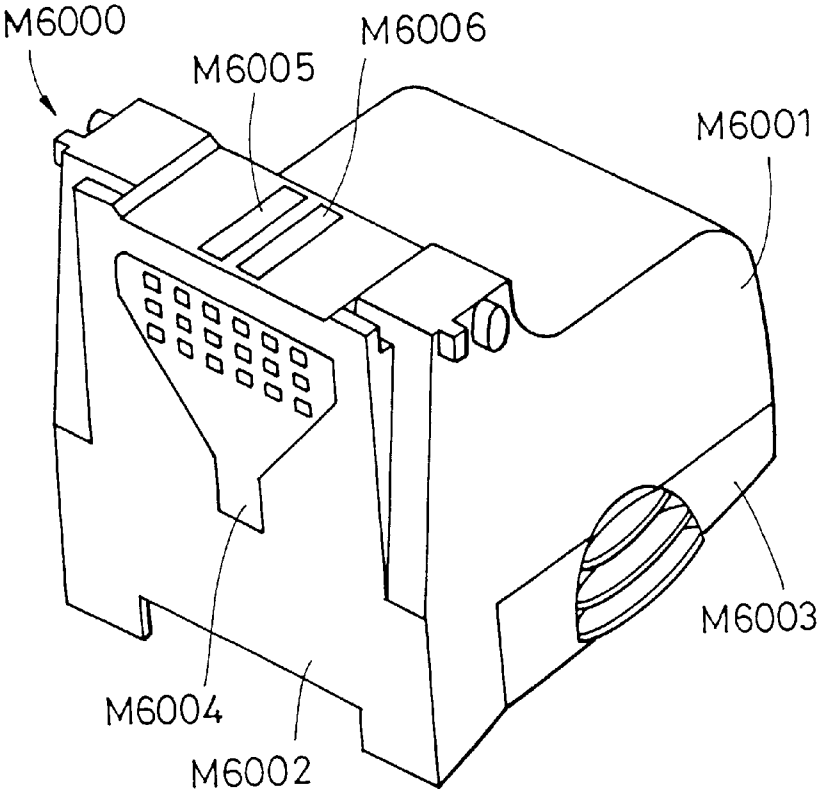
FIG. 13 is a perspective view illustrating a scanner cartridge according to an embodiment of the present invention.
Figure 13A:
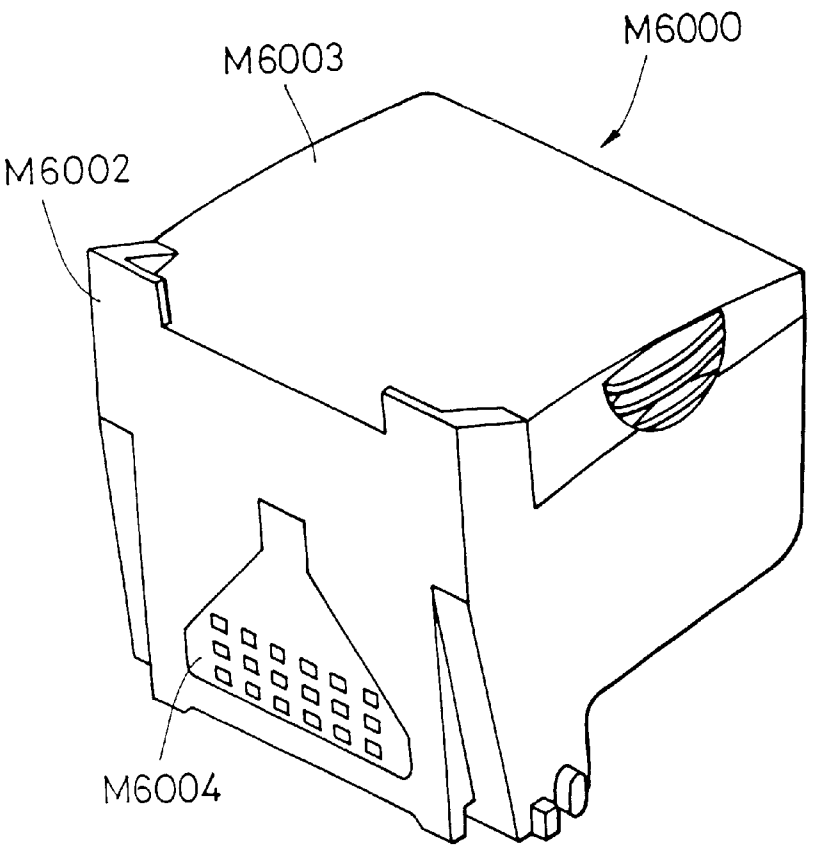

The printer according to the present embodiment can also be used as a reading device by exchanging the recording head with a scanner, as shown in FIG. 13.

This scanner moves along with the carriage on the printer side, and reads original document images supplied instead of recording media in the sub-scanning direction, so as to read original document image information of one sheet by alternating the reading action and the sheet feeding action for the original.

FIG. 13 is a diagram illustrating a schematic configuration of this scanner M6000.

As shown in the figure, a scanner holder M6001 has a box-shaped form, with the optical system and processing circuits and the like necessary for reading being stored therein. Also, a scanner reading lens M6006 is provided at a portion facing the face of the original at the time of mounting the scanner M6000 to the carriage M4001, so that the original document images can be read thereby. A scanner illuminating lens M6005 has an unshown light source therein, and light emitted from the light source is irradiated onto the original.

A scanner cover M6003 fixed to the bottom of the scanner holder M6001 fits to the scanner holder M6001 so as to shield light within, and detachability thereof to the carriage M4001 is improved by a louver-shaped grasping portion formed on the side face thereof. the external form of the scanner holder M6001 is generally the same as that of the recording head H1001, so the scanner holder M6001 can be attached to and detached from the carriage M4001 in generally the same manner as with the recording head cartridge H1000.

Also, while a board having the processing circuit is stored in the scanner holder M6001, a scanner contact PCB connected to the board is exposed externally, so at the time of mounting the scanner M6000 to the carriage M4001, the scanner contact PCB M6004 comes into contact with the contact FPC E0011 at the side of the carriage M4001, thereby electrically connecting the board to the control system of the main unit, via the carriage M4001.

I 7 Storing Box

Figure 14:
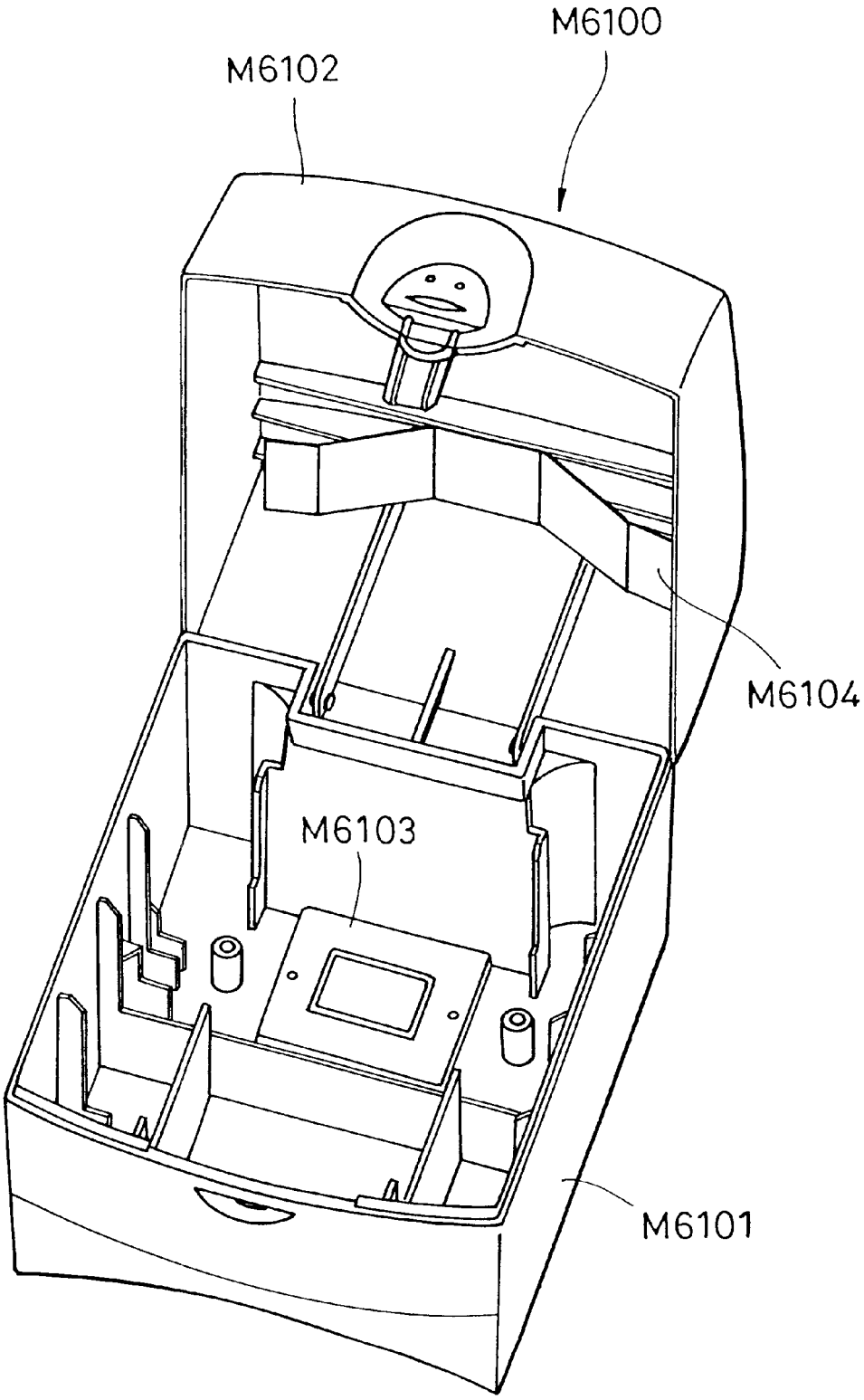
FIG. 14 is a perspective view illustrating a storing box according to an embodiment of the present invention.

FIG. 14 is a diagram illustrating a storing box M6100 for storing the recording head H1001.

This storing box M6100 comprises a storing box base M6101 having an opening upwards, a storing box cover M6102 axially connected to the storing box base M6101 so as to open and close the opening hereof, a storing box cap M6103 fixed to the bottom of the storing box base M6101, and a storing box spring M6104 having a plate-spring-shaped form fixed to the upper face portion within the storing box cover M6102.

In the event of storing the recording head in the storing box configured as described above, the recording head is inserted into the storing box base M6101 such that the nozzle portion faces the storing box cap, and the storing box cover M6102 is closed so that the retaining portion of the storing box base M6101 engages the storing box cover M6102, thereby maintaining the storing box cover M6102 in a closed-off state. In this closed-off state, the storing box spring M6104 presses the recording head 1001, so the nozzle portion of the recording head 1001 is covered by the storing box cap M6103 in a sealed state. Accordingly, the storing box allows the recording head to be stored while preventing adhesion of dust to the nozzles and also preventing evaporation of ink, so the recording head can be maintained in a suitable state for a long time.

Also, the storing box M6100 for storing the recording head H1001 can also be used for storing the scanner M6000. However, ink has adhered to the storing box cap M6103 for protecting the nozzle portion of the recording head H1001, so the face upon which are formed the scanner reading lens M6006 and the scanner illuminating lens M6005 should be stored in a direction distanced from the storing box cap M6103 further than the nozzle position face of the recording head H1001 so that the ink adhered to the storing box cap M6103 does not come into contact.

I 8 Configuration Example of Electrical Circuit of the Printer

Next, the configuration of the electrical circuit according to an embodiment of the present invention will be described. FIG. 15 is a diagram schematically illustrating the overall configuration of the electrical circuit according to the present embodiment.

The electrical circuit according to the present embodiment primarily is made up of a carriage board (CRPCB) E0013, a main PCB (Printed Circuit Board) E0014, an electric power unit E0015, and so forth. Here, the electric power unit E0015 is connected to the main CPB E0014, and supplies the various types of driving electrical power. Also, the carriage board E0013 is a print board unit mounted on the carriage M4001 (FIG. 2), and functions as an interface for exchanging signals with the recording head via the contact FPC E0011, as well as detecting change in the positional relation of the encoder scale E0005 and the encoder sensor E0004 based on pulse signals output from the encoder sensor E0004 accompanying the movement of the carriage M4001, and outputting the output signals thereof to the main PCB E0014 via the flexible flat cable (CRFFC) E0012.

Further, the main PCB E0014 is a printed board unit for handling the driving control of the units of the ink-jet recording apparatus according to the present embodiment, having upon the board I/O ports corresponding to a page end sensor (PE sensor) E0007, an automatic sheet feeder (ASF) sensor E0009, a cover sensor E0022, a parallel interface (parallel I/F) E0016, a serial interface (serial I/F) E0017, a resume key E0019, an LED E0020, an electric power key E0018, a buzzer E0021, and so forth. Also, the main PCB E0014 is connected to the motor E0001 serving as a driving source for main scanning of the carriage M4001 (CR motor), the motor E0002 serving as a driving source for transporting the recording medium (LF motor), and the motor E0003 used for both recovery of the recording head and sheet feeding action of recording media (PG motor) a controls driving of these motors, as well has having connection interfaces with the ink-empty sensor E0006, GAP sensor E0008, PG sensor E0010, CRFFC E0012, and electric power source unit E0015.

Figure 16:
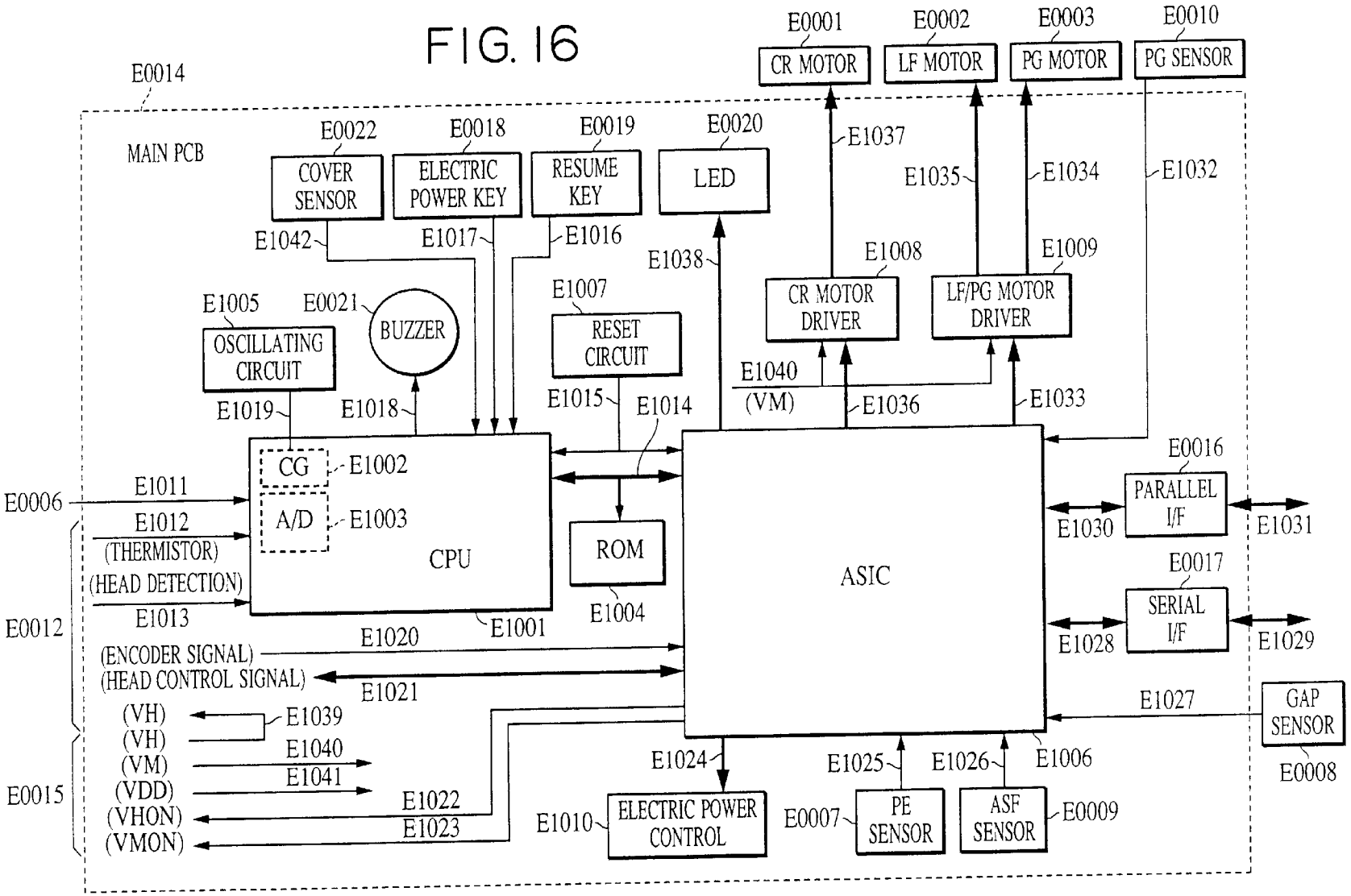
FIG. 16 is a block diagram illustrating an example of the internal configuration of a main PCB shown in FIG. 15.

FIG. 16 is a block diagram illustrating the internal configuration of the main PCB E1004.

In the figure, reference numeral E1001 denotes a CPU, and this CPU E1001 has a clock generator (CG) E1002 connected to an oscillating circuit E1005 therein, for generating system clocks from the output signals E1019 thereof. Also, the CPU E1001 is connected to ROM E1004 and an ASIC (Application Specific Integrated Circuit) E1006 via a control bus E1014, so as to perform control of the ASIC E1006, and detection of the state of the input signals E1017 from the electric power key, input signals E1016 from the resume key, cover detection signals E1042, and head detection signals (HSENS) E1013, and to further carry out driving the buzzer E0021 by the buzzer signals (BUZ) E1018, detecting the state of the ink-empty detection signals (INKS) E1011 connected to the A/D converter E1003 built in and of the temperature detection signals (TH) E1012 with a thermistor, while performing other various types of logic computations and conditions judgment and so forth, thereby handing driving control of the ink-jet recording apparatus, according to the programs stored in the ROM.

Now, the head detection signals E1013 are head mounting detection signals input from the recording head cartridge H1000 via the flexible flat cable E0012, carriage board E0013 and contact flexible print cable E0011, and the ink-empty detection signals E1011 are analog signals output from the ink-empty sensor E0006 and temperature detection signals E1012 are analog signals from an unshown thermistor provided on the carriage board E0013.

Reference numeral E1008 denotes a CR motor driver, having a motor electric power source (VM) E1040 as the driving source thereof, for generating CR motor driving singles E1037 following CR motor control signals E1036 from the ASIC E1006, thereby driving the CR motor E0001. Reference numeral E1009 denotes an LF/PG motor driver, having the motor electric power source E1040 as the driving source thereof, for generating LF motor driving signals E1035 following pulse motor control signals (PM control signals) E1033 from the ASIC E1006, thereby driving the LF motor, and also generating PG motor driving signals E1034 and driving the PG motor.

Reference numeral E1010 denotes an electric power source control circuit, for controlling supply of electric power to the sensors and the like having light-emitting elements, following electric power control signals E1024 from the ASIC E1006. The parallel I/F E0016 transmits parallel I/F signals E1030 from the ASIC E1006 to an externally-connected parallel I/F cable E1031, and also transmits the signals of the parallel I/F cable E1031 to the ASIC E1006. The serial I/F E0017 transmits serial I/F signals E1028 from the ASIC E1006 to an externally-connected serial I/F cable E1029, and also transmits the signals of the serial I/F cable E1029 to the ASIC E1006.

On the other hand, head electric power (VH) E1039 and motor electric power (VM) E1040, and logic electric power (VDD) E1041 are supplied from the electric power source unit E0015.

Also, head electric power ON signals (VHON) E1022 and motor electric power ON signals (VMON) E1023 are input from the ASIC E1006 to the electric power source unit E0015, thereby controlling on/off of the head electric power E1039 and the motor electric power E1040, respectively. The logic electric power (VDD) E1041 supplied from the electric power source unit E0015 is subjected to voltage conversion as necessary, and supplied to the various parts within the main PCB E0014.

Also, the head electric power signal E1039 is sent out onto the flexible flat cable E0011 following smoothing on the main PCB E0014, and used for driving the recording head cartridge H1000. Reference numeral E1007 denotes a resetting circuit, which detects dropping of the logic electric power voltage E1041 and supplies resent signals (RESET) E1015 to the CPU E1001 and ASIC E1006, thereby performing initialization.

This ASIC E1006 is a single-chip semiconductor integrated circuit, controlled by the CPU E1001 via the control bus E1014, for outputting the above-described CR motor control signals E1036, PM control signals E1033, electric power control signals E1024, head electric power ON signals E1022, and motor electric power ON signals E1023 and the like, and also exchanging signals with the parallel I/F E0016 and the serial I/F E0017, as well as detecting the state of PE detecting singles (PES) E1025 from the PE sensor E0007, ASF detecting signals (ASFS) E1026 from the ASF sensor E0009, GAP detection signals (GAPS) E1027 from a sensor (GAP sensor) E0008 for detecting the gap between the recording head and recording medium, and PG detection signals (PGS) E1032 from the PG sensor E0010, transmitting the data representing the state of these signals to the CPU E1001 via the control bus E1014, whereby the CPU E1001 controls the driving of the LED driving signals E1038 based on the input data to light or turn off the LED E0020.

Further, the ASIC E1006 detects the state of encoder signals (ENC) E1020 and generates timing signals, thereby controlling the recording operations by interfacing with the recording head cartridge H1000 with the head control signals E1021. Now, encoder signals (ENC) E1020 are output signals of the CR encoder sensor E0004 which are input through the flexible flat cable E0012. Also, head control signals E1021 are supplied to the recording head H1001 via the flexible flat cable E0012, carriage board E0013, and contact FPC E0011.

Figure 17:
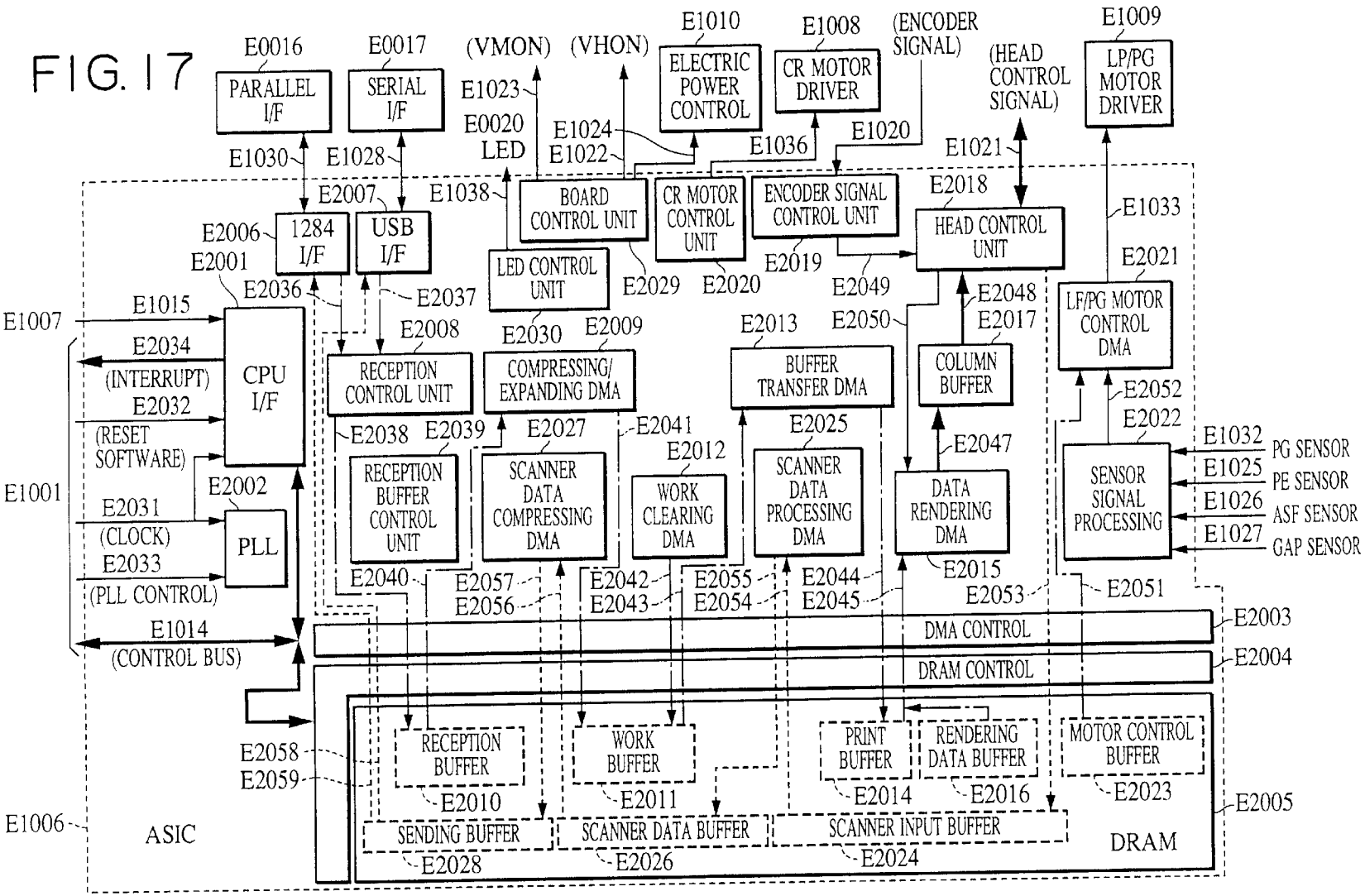
FIG. 17 is a block diagram illustrating an example of the internal configuration of an ASIC shown in FIG. 16.

FIG. 17 is a block diagram illustrating an example of the internal configuration of the ASIC E1006. In the figure, with regard to connection between the blocks, only the flow of data relating to the control of the head and the mechanisms, such as recording data and motor control data is shown, and control signals relating to reading from and writing to the registers built into each block, clocks, control signals relating to DMA control, etc., are omitted for the sake of simplicity of the diagram.

In the figure, reference numeral E2002 denotes a PLL controller, which generates clocks (not shown) to be supplied to the greater portion within the ASIC E1006, by the clock signals (CLK) E2031 and PLL control signals (PLLON) E2033 output from the CPU E1001 as shown in FIG. 16.

Also, reference numeral E2001 denotes a CPU interface CPU I/F) for performing control such as reading from and writing to registers for each of the blocks such as described below, and supplying clocks to some blocks and accepting interruption signals (neither shown) and so forth, based on reset signals E1015, soft reset signals (PDWN) E2032 output from the CPU E1001, reset signals E1015, clock signals (CLK) E2031, and control signals from the control bus E1014, thereby outputting interruption signals (INT) E2034 to the CPU E1001, notifying of interruptions occurring within the ASIC E1006.

Also, reference numeral E2005 denotes a DRAM, which as a recording data buffer has the areas of receiving buffer E2010, work buffer E2011, print buffer E2014, rendering data buffer E2016, and so forth, and also having a motor control buffer E2023 for motor control, and further having area as a buffer used in the scanner operation mode of scanner input buffer E2024, scanner data buffer E2026, sending buffer E2028, and so forth instead of the recording data buffer described above.

This DRAM E2005 is also used as work area necessary of the operation of the CPU E1001. That is, reference numeral E2004 denotes a DRAM control unit, for switching between access to the DRAM E2005 from the CPU E1001 via the control bus and access from a later-described DAM control unit E2003 to the DRAM E2005, thereby performing reading from and writing to the DRAM E2005.

At the DMA control unit E2003, requests (not shown) from each block are accepted, and in the event of address signals or control signals (not shown), or writing action, wiring data E2038, E2041, E2044, E2053, E2055, E2057, and so forth are output to the DRAM control unit, thereby accessing the DRAM. Also, in the event of reading out, the readout data E2040, E2043, E2045, E2051, E2054, E2056, E2058, and E2059, from the DRAM control unit E2004, is handed to the request block.

Also, reference numeral E2006 denotes an IEEE1284 interface, which, under control of the CPU E1001 via the CPU I/F E2001 performs interactive communication interfacing with unshown external hosts via the parallel I/F E0016, hands reception data from the parallel I/F E0016 at the time of recording (i.e., PIF reception data E2036) to the reception control unit E2008 by DMA processing, and transmits data stored in the sending buffer E2028 within the DRAM E2005 at the time of scanner reading (i.e., 1284 transmission data (RDPIF) E2059) to the parallel I/F by DAM processing.

Reference numeral E2007 denotes a Universal Serial Bus (USB) I/F which, under control of the CPU E1001 via the CPU I/F E2001 performs interactive communication interfacing with unshown external hosts via the serial I/F E0017, hands reception data from the serial I/F E0017 at the time of printing (i.e., USB reception data E2037) to the reception control unit E2008 by DMA processing, and transmits data stored in the sending buffer E2028 within the DRAM E2005 at the time of scanner reading (i.e., USB transmission data (RDUSB) E2058) to the serial I/F E0017 by DAM processing. The reception control unit E2008 writes reception data (WDIF) E2038 from the selected interface of the 1284 I/F E2006 or USB I/F E2007, to the reception buffer write address managed by the reception buffer control unit E2039.

Reference numeral E2009 denotes a compressing/expanding DMA controller which, under control of the CPU E1001 via the CPU I/F E2001, reads out reception data (raster data) stored in the reception buffer E2010 from the reception buffer read address managed by the control buffer control unit E2039, compresses/expands the data (RDWK) E2040 according to the specified mode, and writes this to the work buffer area as a recording code string (WDWK) E2041.

Reference numeral E2013 denotes a recording buffer transfer DMA controller which, under control of the CPU E1001 via the CPU I/F E2001, reads out recording code (RDWP) E2043 stored in the work buffer E2011, rearranges each recording code to an address on the print buffer E2014 so as to be suitable for the data transfer order to the recording head cartridge H1000, and transfers this (WDWP E2044). Also, reference numeral E2012 denotes a work clear DMA controller which, under control of the CPU E1001 via the CPU I/F E2001, repeatedly writes specified work fill data (WDWF) E2042 to work buffer area regarding which transfer by the recording buffer transfer DMA controller E2013 has been completed.

Reference numeral E2015 denotes a recording data rendering DMA controller which, under control of the CPU E1001 via the CPU I/F E2001, triggers data rendering timing signals E2050 from the head control unit E2018, reads out recording code re-arranged on the print buffer and the rendering data written on the rendering data buffer E2016, and writes the rendered recording data (RDHDG) E2045 to a column buffer E2017 as column buffer writing data (WDHDG) E2047. Here, the column buffer E2017 is SRAM which temporarily stores the transfer data (rendered recording data) to the recording head cartridge H1000, and is shared and managed by both the recording data rendering DMA controller E2015 and the head control unit E2018 by handshake signals (not shown) between the two blocks.

Reference numeral E2018 denotes a head control unit which, under control of the CPU E1001 via the CPU I/F E2001, performs interfacing with the recording head cartridge H1000 or the scanner by head control signals, and also outputs data rendering timing signals E2050 to the recording data rendering DMA controller based on the head driving timing signals E2049 from the encoder signals control unit E2019.

Also, at the time of printing, rendering recording data (RDHD) E2048 is read out from the column buffer according to the head driving timing signals E2049, and the data thereof is output to the recording head cartridge H1000 as head control signals E1201.

Also, in the scanner reading mode, intake data (WDHD) E2053 input as the head control unit E2018 is transferred to the scanner input buffer E2024 on the DRAM E2005 by DMA transfer. Reference numeral E2025 denotes a scanner data processing DMA controller which, under control of the CPU E1001 via the CPU I/F E2001, reads out the input buffer readout data (RDAV) E2054 stored in the scanner input buffer E2024, and writes the processed data (WDAV) E2055 subjected to averaging and other like processing, to the scanner data buffer E2026 on the DRAM E2005. Reference numeral E2027 denotes a scanner data compression DMA controller which, under control of the CPU E1001 via the CPU I/F E2001, reads out processed data (RDYC) E2056 on the scanner data buffer E2026 and performs data compressing, and writes and transfers the compressed data (WDYC) E2057 to the sending buffer E2028.

Reference numeral E2019 denotes an encoder signal processing unit which, upon reception of encoder signals (ENC), outputs head driving timing signals E2049 following the mode determined by the control of the CPU E1001, and also stores information relating to the position and speed of the carriage M4001 obtained from the encoder signals E1020 in the register, and provides this to the CPU E1001. Based on this information, the CPU E1001 determines the parameters for the control of the CR motor E0001. Also, reference numeral E2020 denotes a CR motor control unit, for outputting CR motor control signals E1036 under control of the CPU E1001 via the CPU I/F E2001.

Reference numeral E2022 denotes a sensor signals processing unit, which, upon receiving the detection signals E1032, E1025, E1026, and E1027, output from the PG sensor E0010, PE sensor E0007, ASF sensor E0009, GAP sensor E0008, and so forth, transmits this sensor information to the CPU E1001 following the mode determined by the control of the CPU E1001, and also outputs sensor detection signals E2052 to the an LF/PG motor controlling DMA controller E2021.

The LF/PG motor controlling DMA controller E2021, under control of the CPU E1001 via the CPU I/F E2001, reads out a pulse motor driving table (RDPM) E2051 from the motor control buffer E2023 on the DRAM E2005 and outputs pulse motor control signals E1033, and also outputs pulse motor control signals E1033 with the sensor detection signals as control triggers, depending on the operation mode.

Also, reference numeral E2030 denotes an LED control unit which, under control of the CPU E1001 via the CPU I/F E2001, outputs LED driving signals E1038. Further, reference numeral E2029 denotes a port control unit which, under control of the CPU E1001 via the CPU I/F E2001, outputs head electric power ON signals E1022, motor electric power ON signals E1023, and electric power control signals E1024.

I 9 Printer Operations

Figure 18:
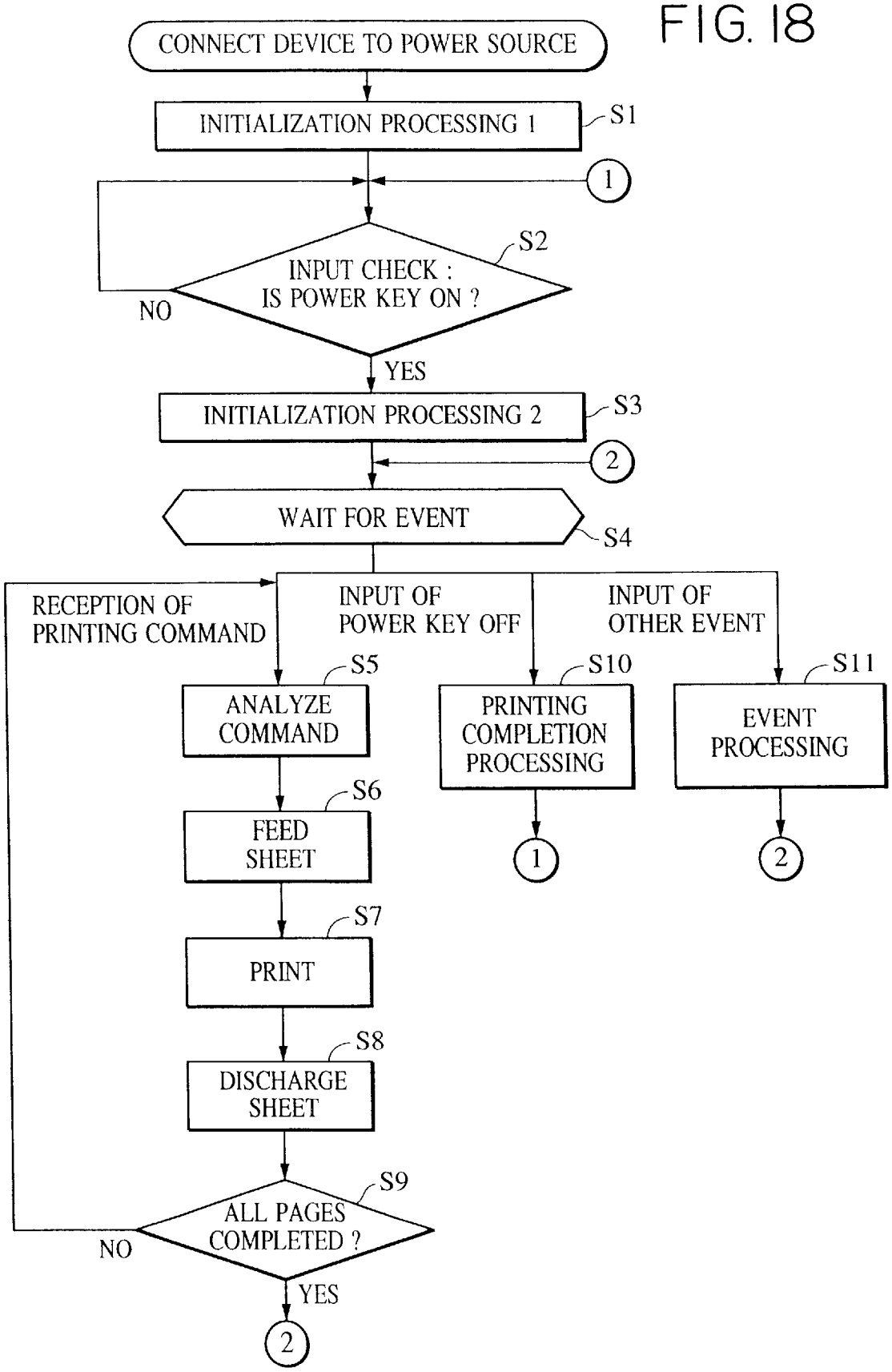
FIG. 18 is a flowchart illustrating an example of operations of the printer according to an embodiment of the present invention.

Next, the operations of the ink-jet recording apparatus according to the embodiment of the present invention configured as described above, will be described based on the flowchart shown in FIG. 18.

Once the apparatus main unit 1000 is connected to an AC power source, first, in step S1, first initialization processing of the apparatus is performed. In this initialization processing, the electrical systems are checked, such as checking the ROM and RAM of the main apparatus, thereby checking whether the apparatus is capable of operating normally electrically.

Next, in step S2, judgment is made regarding whether the electric power key E0018 provided on the upper case M1002 of the apparatus main unit M1000 has been turned on, and in the event that the electric power key E0018 has been pressed, the flow proceeds to the next step S3, where the second initialization processing is performed.

In the second initialization processing, the driving mechanisms and the recording head of the apparatus are checked. That is, whether or not the apparatus is capable of operating normally is checked at the time of performing initialization of the motors and reading of head information.

Next, in step S4, the flow waits for an event. That is, monitoring is performed regarding instruction events from an external I/F, panel key events due to user operation, and internal control events, for the apparatus, and in the event that one of these events occurs, processing corresponding to the event is executed.

For example, in the event that a printing instruction event is received from an external I/F in step S4, the flow proceeds to step S5, and in the event that an electric power key event due to user operation occurs in the same step the flow proceeds to step S10, and in the event that another event occurs in the same step the flow proceeds to step S11. Now, in step S5, the printing instructions from the external I/F are analyzed, judgment is made regarding the specified sheet type, sheet size, printing resolution, sheet feeding method, etc., data representing the judgment results are stored in RAM E2005 within the apparatus, and the flow proceeds to step S6.

Next, in step S6, sheet feeding is started by the sheet feeding method specified in step S5, the sheet is fed to the recording start position, and the flow proceeds to step S7. In step S7, the recording operation is carried out. In this recording operation, recording data sent from the external I/F is temporarily stored in the recording buffer, and next the CR motor E0001 is driven so as to start moving of the carriage M4001 in the main scanning direction, while the recording data stored in the print buffer E2104 is supplied to the recording head H1001 so as to record one line, and once the recording operation for one line of recording data is completed the LF motor E0002 is driven and the FL roller M3001 is rotated so as to feed the sheet in the sub-scanning direction. Subsequently, the above actions are repeatedly executed, and at the point that recording of the recording data for one page from the external I/F is completed, the flow proceeds to step S8.

In step S8, the LF motor E0002 is driven, the sheet discharging roller M2003 is driven, sheet feeding is repeated until judgment is made that the sheet has been completely discharged from the apparatus, and at the final stage the sheet will be completely discharged on the sheet discharging tray M1004*a*.

Next, in step S9, judgment is made whether or not the recording operation has been completed for all pages to be recorded, and in the event that there are pages remaining to be recorded, the flow returns to step S5, then repeats the actions of step S5 through S9, and at the point that the recording operation has been completed for all pages to be recorded the recording operation ends, the flow then goes to step S4, and waits for the next event.

On the other hand, step S10 performs printer ending processing, stopping the operations of the apparatus. That is, the apparatus is put in a state wherein the electric power can be turned off in order to turn off the power to the motors or head, the electric power is turned off and the flow proceeds to step S4, and waits for the next event.

Also, in step S11, event processing other than that described above is performed. For example, processing corresponding to recovery instructions from the panel keys of the apparatus or an external interface, or a recovery event occurring internally, is executed. Following the processing, the flow proceeds to step S4, and waits for the next event.

I 10 Characteristic Configurations

Next, embodiments of the configurations characteristic of the present invention for a printer of the above configuration will be described will reference to the drawings.

(First Embodiment)

A first embodiment of the present invention will be described with reference to FIGS. 19 through 24.

Figure 19:
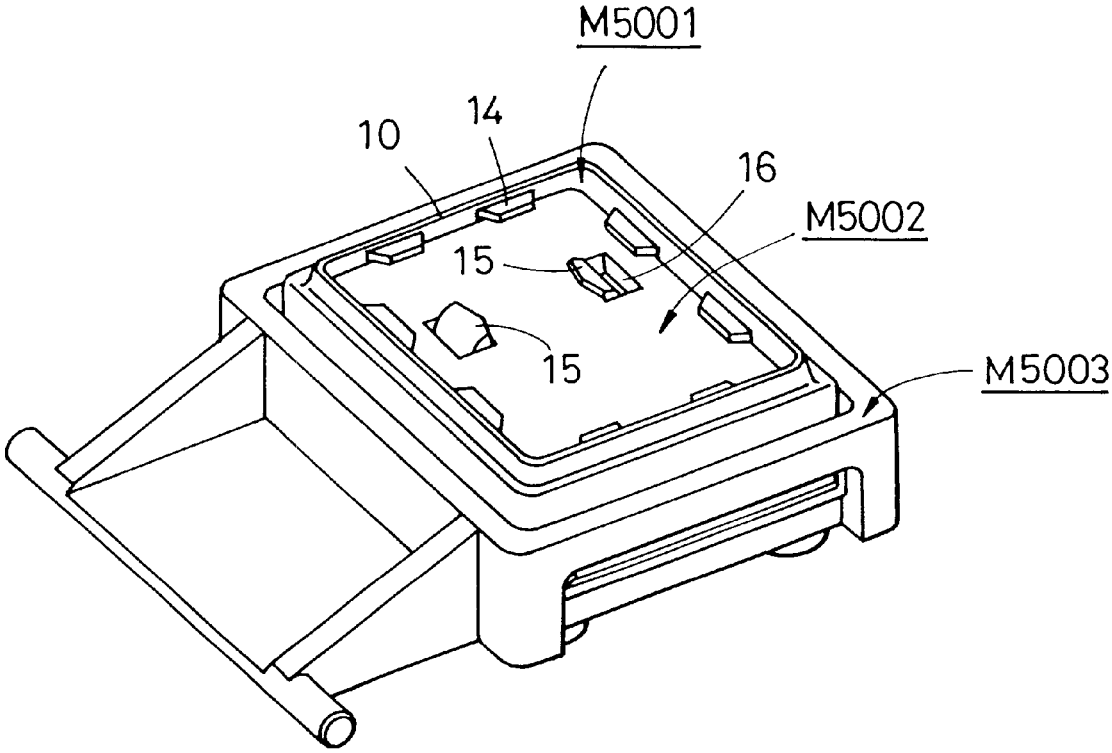
FIG. 19 is a perspective view illustrating an example of a cap unit which is characteristic of a first embodiment of the present invention.
Figure 20:
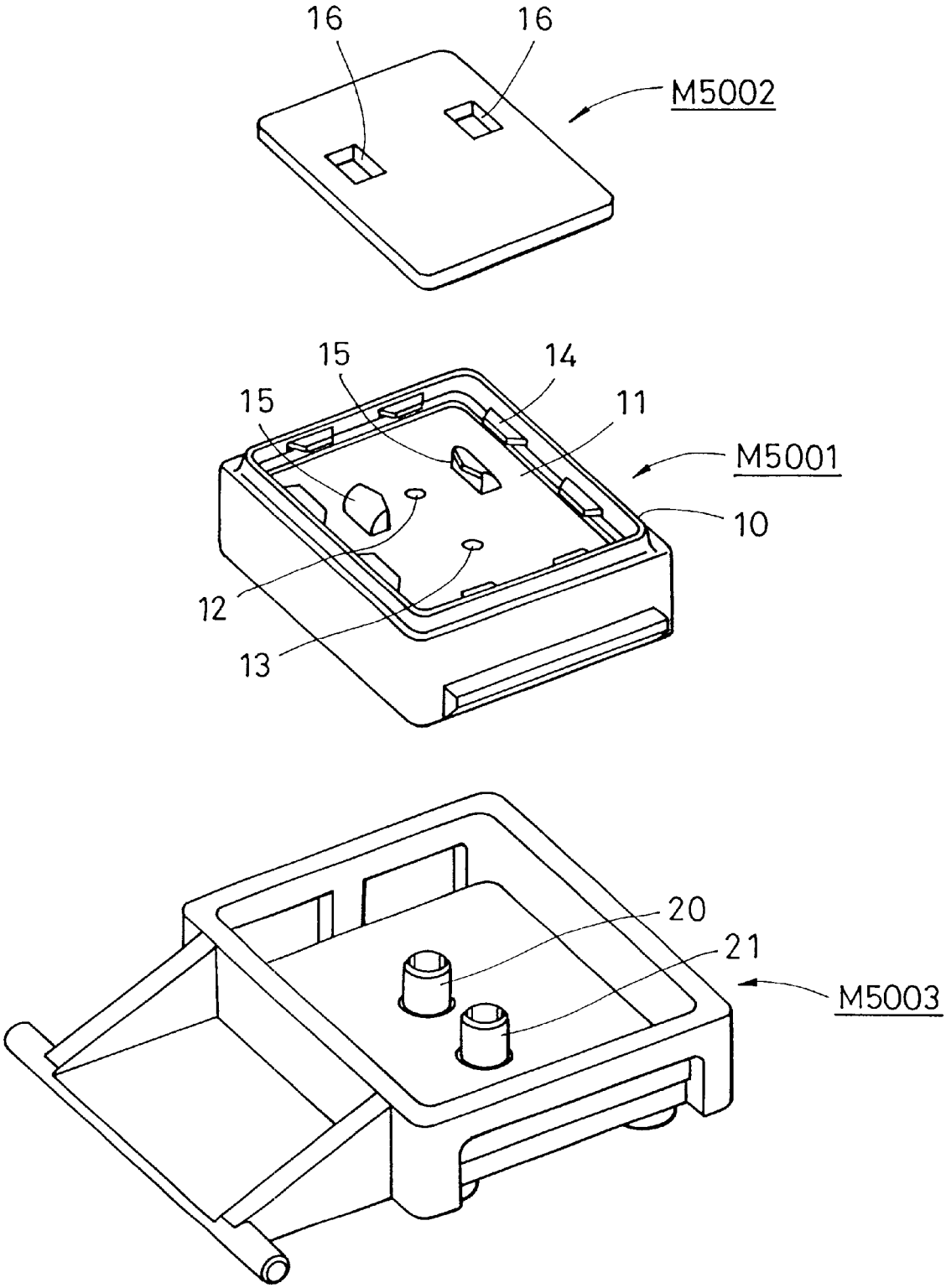
FIG. 20 is a disassembled perspective view illustrating the cap unit shown in FIG. 19 before assembly.
Figure 21:
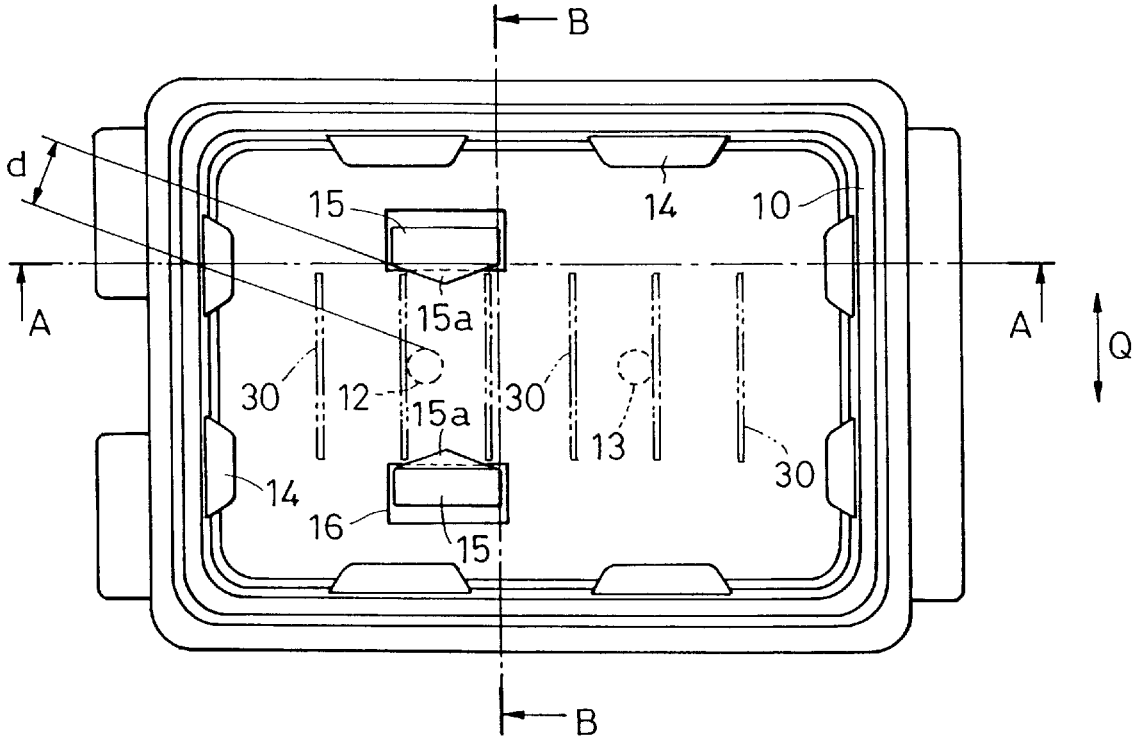
FIG. 21 is a plan view of the cap unit shown in FIG. 19.
Figure 22:
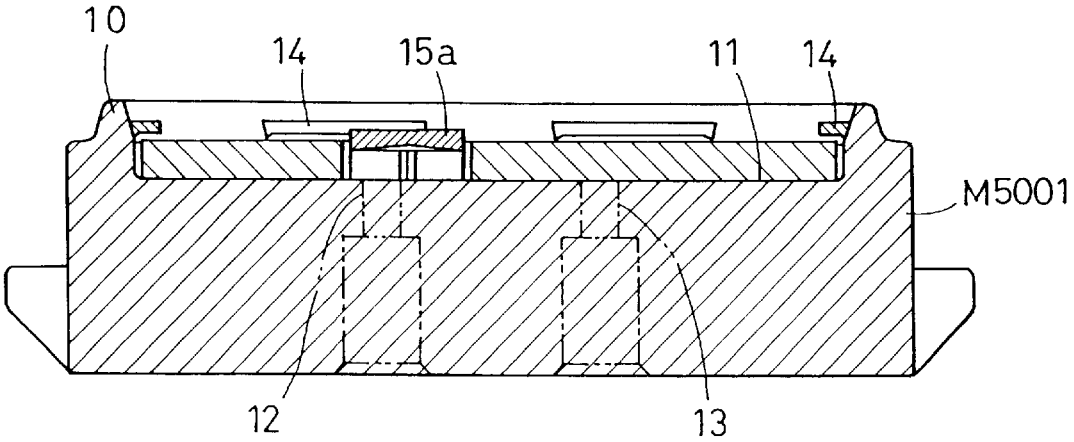
FIG. 22 is a cross-sectional view along line A—A in FIG. 21.
Figure 23:
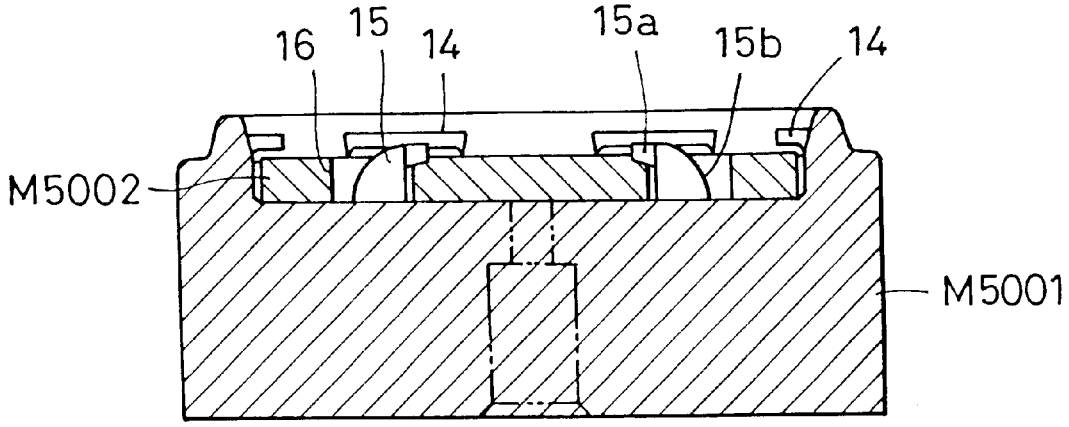
FIG. 23 is a cross-sectional view along line B—B in FIG. 21.

FIG. 19 is a perspective view illustrating the configuration of the cap unit of the recovery unit of the recording apparatus, FIG. 20 is a disassembled perspective view thereof, FIG. 21 is a plan view thereof, FIG. 22 is a cross-sectional view along line A—A in FIG. 21, and FIG. 23 is a cross-sectional view along line B—B in FIG. 21.

As can be seen from these drawings, the cap unit is made up of a cap M5001, absorbing material (ink absorbing member) M5002, and a cap holder M5003.

The cap M5001 is formed of an elastic member such as rubber or the like, and is attached to the cap holder M5003. The cap M5001 has a sealing space defined by a perimeter (rib portion) 10 in contact with the ink discharging orifice face of the recording head H1001 upon which the ink discharging orifices are arrayed (i.e., the surface of the recording element substrate H1100), the bottom face 11, and within the rib 10.

A suctioning opening 12 and atmosphere communicating opening 13 are formed at the bottom of the cap M5001 The suctioning opening 12 is connected to the tube pump M5100 via a suctioning path 20 formed in the cap holder M5003, and the pump tube M5019. The atmosphere communicating opening 13 is connected to the valve rubber M5036 via an atmosphere communicating channel 21 formed on the cap holder M5003, and the valve tube M5010.

Ink absorbing member M5002 is layered on the bottom face 11 of the cap M5001 so as to cover the entire bottom face thereof. As described above, this ink absorbing member M5002 is positioned so as to face the ink discharging orifice face of the recording head H1001 with a predetermined spacing therebetween at the time of capping.

The ink absorbing member M5002 is formed of a continuous amorphous material (e.g., polyvinyl formal), so that ink can flow via the air holes formed within.

Eight ledge portions 14 are provided on the inner wall of the rib portion 10 of the cap M5001, these multiple ledge portions 14 preventing the ink absorbing member M5002 from rising up at the edge of the ink absorbing member M5002.

On the other hand, a pair of holding members 15 for preventing the ink absorbing member M5002 from rising up near the suctioning opening 12 are provided near the suctioning opening 12, i.e., at a position distanced from the perimeter rib portion 10 of the cap M5001.

These holding members 15 are arranged so as not to come into contact with the ink discharging orifice face when the rib portion 10 of the cap M5001 is in contact with the ink discharging orifice face.

In FIG. 21, reference numeral 30 denotes multiple ink discharging orifice rows, with multiple ink discharging orifices being arrayed for each discharging orifice row. In this first embodiment, the pair of holding members 15 is arrayed in the direction Q extended from one discharging orifice row, and is positioned so as to have the suctioning opening 12 therebetween. Further in this case, the pair of holding members 15 is arrayed so as to not face the ink discharging orifice rows 30, so that all ink discharging orifice face the ink absorbing member M5002. Accordingly, the ink drawn out from the ink discharging orifices at the time of suctioning recovery is speedily and directly absorbed by the ink absorbing member M5002, and accordingly color mixing in the discharging orifices due to ink remaining around the ink discharging orifice face is prevented.

The holding members 15 protrude from the bottom 11 of the cap M5001, with ledges 15*a* being formed on the tips thereof. A generally arc-shaped inclined face 15*b* is formed from the ledge 15*a* across the back side (see FIG. 23), so that ink adhering to the holding member 15 flows down. Thus, color mixing in the ink discharging orifices due to adhered ink re-adhering in great amounts around the ink discharging orifice face is prevented.

Costs can be reduced by forming the holding members 15 integrally with the cap M5001 using the same material as the cap M5001.

Two rectangular through holes 16 corresponding to the position of the holding members 15 are formed in the ink absorbing member M5002, the holding members 15 of the cap M5001 pass through the two through holes 16, and the ink absorbing member M5002 is held between the ledge portion 15*a* of the holding member 15 and the bottom 11 of the cap M5001, thereby bringing the ink absorbing member M5002 into close contact with the suctioning opening 12 situated between the pair of holding members 15 in a sure manner.

Incidentally, upon fixing the ink absorbing member M5002 with the holding members 15, forming the holding members 15 and the ink absorbing member M5002 with an elastic material and bringing the holding members 15 and the ink absorbing member M5002 into contact in a pressed state allows the ink absorbing member M5002 to be fixed even more securely, thereby increasing the degree of tight contact between the suctioning opening 12 and the ink absorbing member M5002.

Now, as shown in FIG. 21, the distance between the suctioning opening 12 and the ledges 15*a* is 2.1 mm, but we have confirmed that there is no problem as long as this distance is 4 mm or less.

Figure 24:
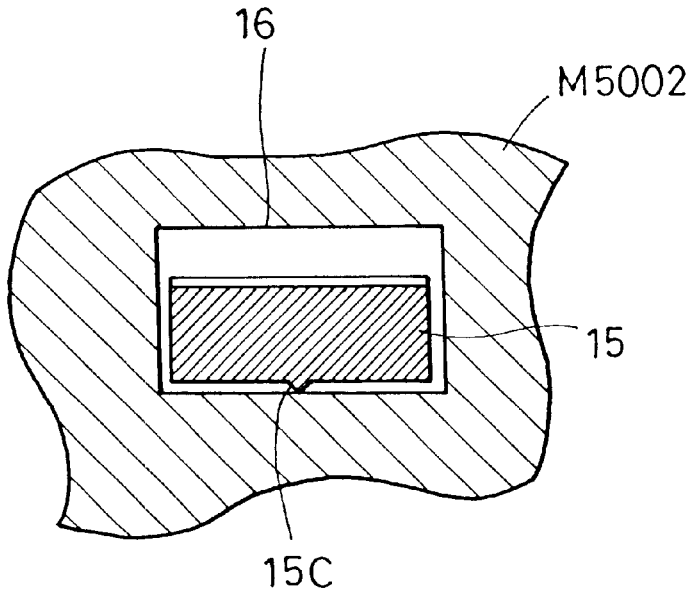
FIG. 24 is a cross-sectional view of the holding member in the cap unit shown in FIG. 19.

FIG. 24 is a cross-sectional view wherein a holding member 15 has been cut away at a height position where the ink absorbing member M5002 exists. As shown in FIG. 24, at the place where the holding member 15 comes into contact with the side wall of the through hole 16 in the ink absorbing member M5002, a rib 15*c* with a triangular cross-sectional form is protruding formed protruding as an elastic member which deforms by contact with the ink absorbing member M5002. The width of this rib 15*c* is 0.3 mm or less.

The rib 15*c* is formed as the same rubber material as the holding member 15 (and the cap M5001), and functions to keep the deformation of the ink absorbing member M5002 as small as possible, by the apex of the triangular cross-section deforming as the ink absorbing member M5002 swells with ink. Also, the deformation of the rib 15*c* returns to the original state with shrinking of the ink absorbing member M5002.

Accordingly, the portion of the ink absorbing member M5002 between the pair of holding member 15, i.e., the portion where the suctioning opening 12 is situated, can be prevented from rising up from the suctioning opening 12 due to deforming from swelling with ink, or becoming loose due to the ink absorbing member M5002 shrinking because of drying and rising up owing to having fallen away from the ledges 15*a,* and accordingly, the assembled state of the ink absorbing member M5002 can be stabilized.

Incidentally, the assembled state of the ink absorbing member M5002 can be stabilized even further by forming a plurality of ribs 15*c* such as shown in FIG. 24 on the inner wall face of the rib portion 10 of the cap M5001 so as to press the outer perimeter of the ink absorbing member M5002 with these ribs.

According to this configuration, the ink drawn out from the ink discharging orifices at the time of suctioning recovery is all absorbed by the ink absorbing member M5002, flows through the ink absorbing member M5002, and is guided out from the suctioning opening 12 of the cap M5001.

Also, in the event of suctioning with the atmosphere communicating opening 13 open (pneumatic suctioning), air flows in through the atmosphere communicating opening 13 of the cap M5001, and the ink stops flowing from the ink discharging orifices of the recording head. At this time, the suctioning opening 12 and the ink absorbing member M5002 are in contact without any gap therebetween due to the holding members 15, so even in the event that the gap is increased, effects that the deformation or margin-of-error in manufacturing has on the state of contact between the ink absorbing member and the suctioning opening can be suppressed. Also, the holding members 15 are provided so as not to come into contact with the ink discharging orifice face when the rib portion 10 of the cap M5001 is in contact with the ink discharging orifice face, so adverse effects on the ink discharging orifice face due to the holding members 15 such as ink adhering, can be prevented.

Accordingly, air can be prevented from flowing into the suctioning opening 12, and the phenomena wherein ink remains within and on the ink absorbing member M5002 without being discharged can be prevented, thereby reducing the amount of residual ink within the cap. Consequently, the amount of ink adhere to the ink discharging orifice face also decreases, and color mixing due to ink adhering to the recording head at the time of opening the cap, or soiling due to scattering of ink in the apparatus at the time of wiping, can be prevented. Further, backflow of ink remaining on the ink discharging orifices causing color mixing at the time of printing which deteriorates image quality, can be prevented.

(Second Embodiment)

Figure 25:
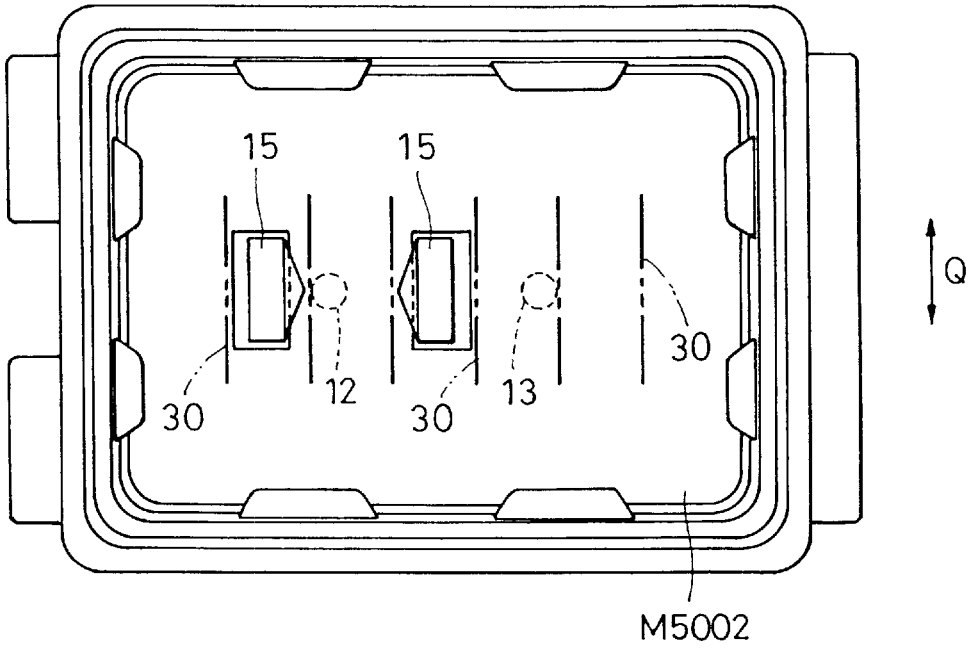
FIG. 25 is a plan view illustrating an example of a cap unit which is characteristic of a second embodiment of the present invention.

FIG. 25 illustrates a second embodiment of the present invention.

With this second embodiment, a pair of holding members 15 is arrayed orthogonal to the direction Q extended from one discharging orifice row 30. The pair of holding members 15 is situated at a position corresponding to between ink discharging orifice rows 30, so as to not face an ink discharging orifice row 30. Of course, the pair of holding members 15 is positioned so as to have the suctioning opening 12 therebetween.

Such an arrangement is effective in the event that the length of the ink discharging orifice row 30 is long in the direction Q. That is to say, in the event of arraying as shown in FIG. 21, the distance from the suctioning opening 12 would be great in the event that the length of the ink discharging orifice row 30 is long in the direction Q.

(Third Embodiment)

Figure 26:
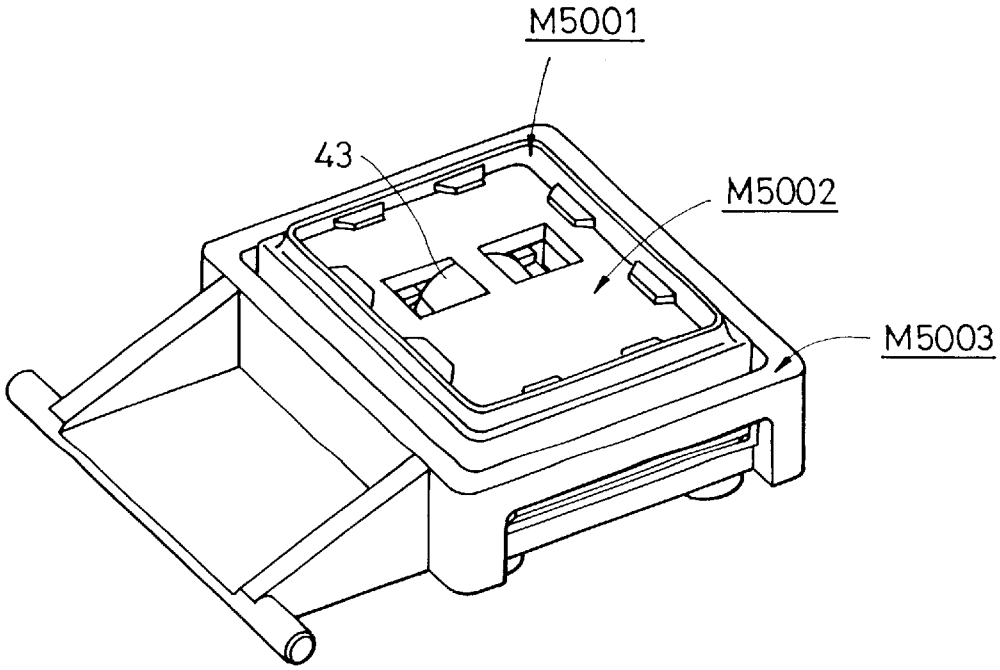
FIG. 26 is a perspective view illustrating an example of a cap unit which is characteristic of a third embodiment of the present invention.
Figure 27:
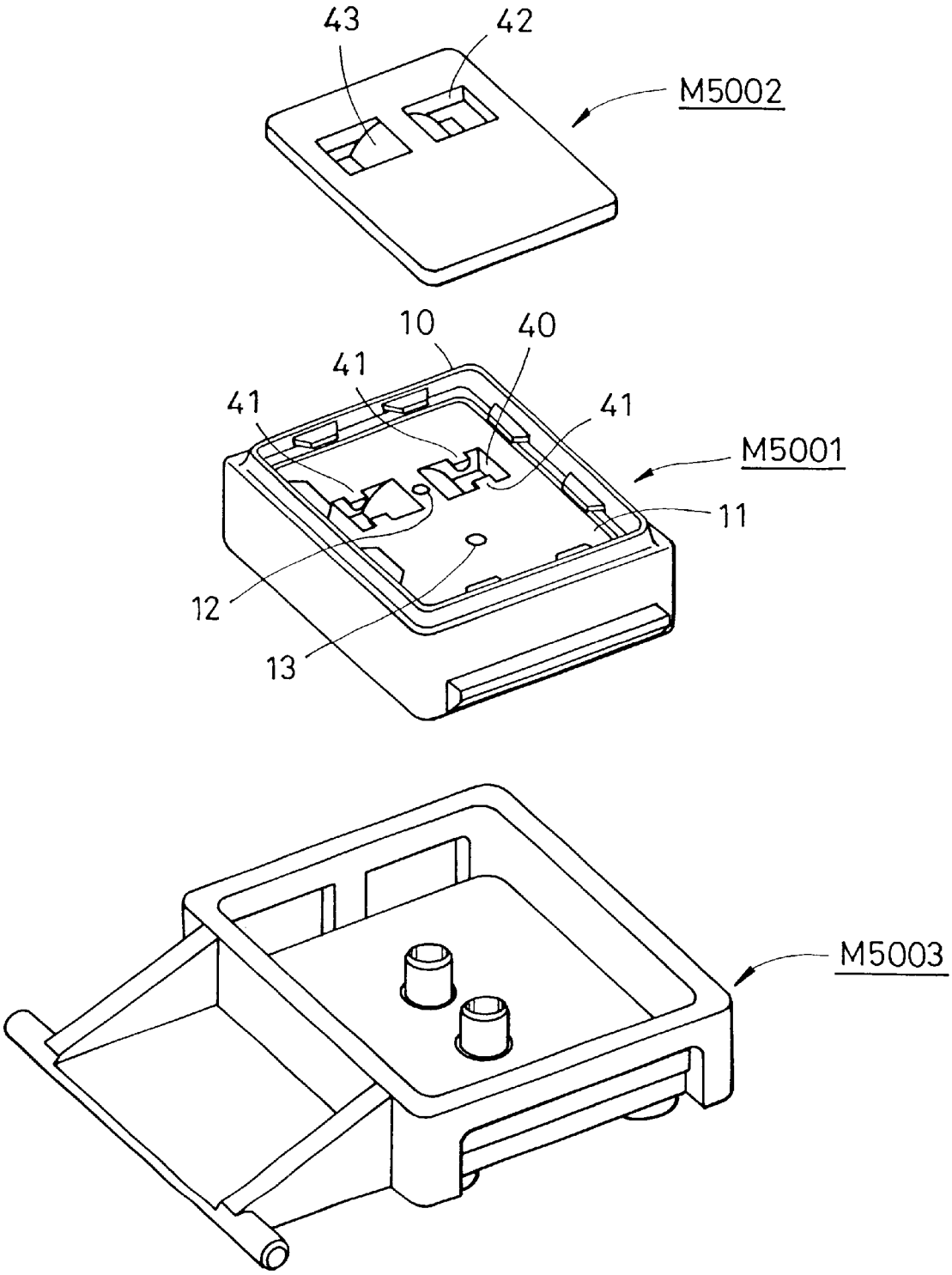
FIG. 27 is a disassembled perspective view illustrating the cap unit shown in FIG. 26 before assembly.

FIGS. 26 and 27 illustrate a third embodiment of the present invention.

With this third embodiment, two recessions 40 are formed on the bottom 11 of the cap M5001 on either side of the suctioning opening 12, and a pair of ledge portions 41 protrude from both sides of each recession 40.

On the other hand, two holes 42 are provided on the ink absorbing member M5002 so as to corresponding to the recessions 40, and cantilever tongues 43 are formed so as to extend downwards at an incline from the inner side faces of the holes 42.

That is, with the third embodiment, a pair of cantilever tongues 43 of the ink absorbing member M5002 are retained by ledges 42 formed on the bottom face 11 of the cap M5001, thereby bringing the ink absorbing member M5002 in contact with the suctioning opening 12 with no gap therebetween.

With the third embodiment, the cantilever tongues 43 serving as holding members are configured so as to not protrude above the upper face of the ink absorbing member M5002 while in the state of securing the ink absorbing member M5002, so there are no unnecessary parts near the ink discharging orifice face, and adhering of ink to the ink discharging orifice face can be prevented in a more effective manner. Also, there is less necessity to take into consideration the positional relation between the holding members and the ink discharging orifices, so the degree of freedom in design increased for both.

(Others)

Although with the above embodiments, two holding members 15 are disposed near the suctioning opening 12, but just one, or three or more, may be disposed instead.

Further, other arbitrary configurations may be used for the form and configurations of the holding members as long as the ink absorbing member M5002 can be held in a sure manner.

Now, an embodiment wherein the present invention is effectively employed is a form wherein thermal energy generated by electro-thermal converters is used to generate film boiling in a liquid to form bubbles.

Figure 28:
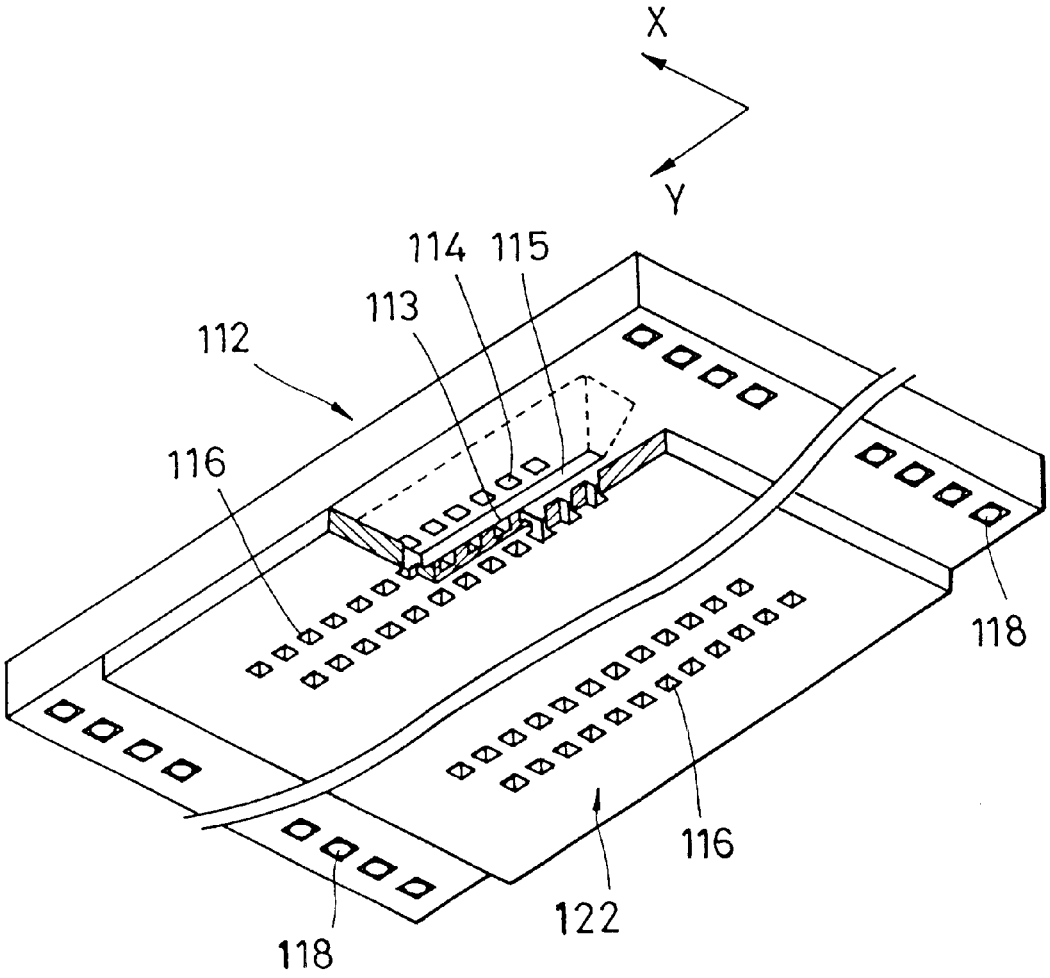
FIG. 28 is a cut-away perspective view illustrating an example of a head chip of an ink-jet recording head according to the present invention.
Figure 29:
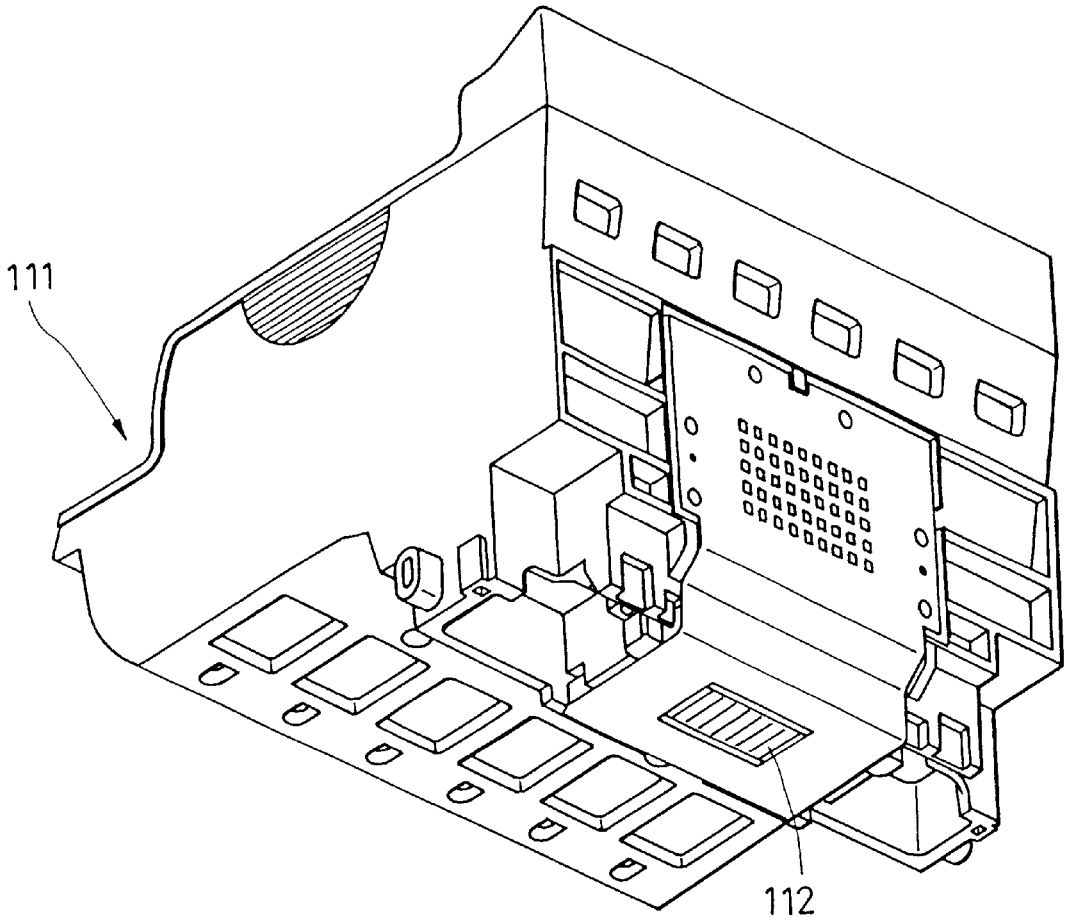
FIG. 29 is a perspective view illustrating an example of the ink-jet recording head according to the present invention.

FIG. 29 shows the entire external view of the ink-jet head 111 according to an embodiment of the present invention, and the cutaway drawing in FIG. 28 shows a head-chip 112 which is a principal portion thereof. the head chip 112 is manufactured using an Si wafer 0.51 mm in thickness for example, and six thin and long ink supplying openings 115 arrayed mutually parallel are formed corresponding to the six colors of ink used with this ink-jet head 111.

Two rows of ink chambers 113 arrayed at even pitch in the longitudinal direction of the ink supplying openings 115 for each ink supplying opening 115 so as to be on either side of the ink supplying opening 115, and provided to each ink chamber 113 is an electro-thermal converter element 114 and a discharging orifice 116 facing the electro-thermal converter element 114 for discharging ink as droplets.

With the present embodiment, two rows of discharging orifices 116 mutually parallel, with ink supplying openings 115 therebetween are arrayed in a so-called staggered array that is offset half pitch, and the ink chambers 113 corresponding to the discharging orifices 116 of each row are arrayed with a pitch of 600 dpi, so the spacing of the discharging orifices 116 arrayed in the longitudinal direction of the ink supplying opening 115 corresponding to each color ink appears to be arrayed in a high-density array of 1200 dpi. Also, the electro-thermal converter elements 114 and the electrode lines 117 formed of Al or the like for supplying electric power to the electro-thermal converter elements 114 are formed on the surface of the Si wafer with a film forming technique, and the other ends of the electrode lines 117 form bumps 118 formed of Au or the like, protruding from the surface of the heat generating substrate 112.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modification and equivalent structures and functions.

What is claimed is:

1. A cap for an ink-jet recording apparatus, comprising:

a cap, having a perimeter coming into contact with a discharging orifice face upon which a discharging orifice for discharging ink is provided, and a sealing space within said perimeter for covering said discharging orifice;

an ink absorbing member provided in said sealing space; and a holding member, sticking out from the bottom of said cap and apart from said perimeter of said cap, for directly holding said ink absorbing member to prevent said ink absorbing member from being removed from said sealing space, wherein said holding member is integrally provided with said cap by the same material as that of said cap, and is disposed at a position not facing an ink discharge orifice of a recording head.

2. A cap for an ink-jet recording apparatus, according to claim 1, wherein said cap has a suctioning opening formed at the bottom face portion thereof, and wherein said holding member is disposed near said suctioning opening.

3. A cap for an ink-jet recording apparatus, according to claim 2, wherein more than one said holding member is provided, with said suctioning opening therebetween.

4. A cap for an ink-jet recording apparatus, according to claim 2, wherein, in a state with the suctioning opening of said cap and said ink absorbing member in contact, the distance between a position wherein said holding member acts upon said ink absorbing member by making contact thereto and the position of said suctioning opening is 4 mm or less.

5. A cap for an ink-jet recording apparatus, according to claim 2, wherein said holding member is configured so as to not protrude above the upper face of said ink absorbing member in a state with the suctioning opening of said cap and said ink absorbing member in contact.

6. A cap for an ink-jet recording apparatus, according to claim 1, wherein at least one of said holding member and said ink absorbing member is formed of an elastic material, and wherein said holding member and said ink absorbing member are disposed in a compressed state.

7. A cap for an ink-jet recording apparatus, according to claim 1, wherein an elastic member which deforms by contact with said ink absorbing member of said holding member is disposed at the point of contact with said ink absorbing member.

8. A cap for an ink-jet recording apparatus, according to claim 7, wherein a hole for accepting said holding member is formed in said ink absorbing member, and wherein said elastic member is disposed on said holding member so as to come into contact with the inner wall of said hole.

9. A cap for an ink-jet recording apparatus, according to claim 7, wherein said holding member is integrally provided with said cap and said elastic member is formed by the same material as that of said cap.

10. A cap for an ink-jet recording apparatus, according to claim 7, wherein said elastic member is a rib.

11. A cap for an ink-jet recording apparatus, according to claim 10, wherein the width of said rib is 0.3 mm or less.

12. A cap for an ink-jet recording apparatus, according to claim 10, wherein said rib has a cross-sectional form of a triangle with the apex thereof toward said ink absorbing member.

13. An ink-jet recording apparatus for recording an image on a recording media using a recording head on which an ink discharging orifice is provided, comprising:

a cap, having a perimeter coming into contact with a discharging orifice face upon which a discharging orifice for discharging ink is provided, and a sealing space within said perimeter for covering said discharging orifice;

an ink absorbing member provided in said sealing space; and a holding member, sticking out from the bottom of said cap and apart from said perimeter of said cap, for directly holding said ink absorbing member to prevent said ink absorbing member from being removed from said sealing space, wherein said holding member is integrally provided with said cap by the same material as that of said cap, and is disposed at a position not facing an ink discharge orifice of a recording head.

14. An ink-jet recording apparatus according to claim 13, wherein said cap has a suctioning opening formed at the base portion thereof, and wherein said holding member is disposed near said suctioning opening.

15. An ink-jet recording apparatus according to claim 14, wherein more than one said holding member is provided, with said suctioning opening therebetween.

16. An ink-jet recording apparatus according to claim 14, wherein, in a state with the suctioning opening of said cap and said ink absorbing member in contact, the distance between a position wherein said holding member acts upon said ink absorbing member by making contact thereto and the position of said suctioning opening is 4 mm or less.

17. An ink-jet recording apparatus according to claim 14, wherein said holding member is configured so as to not protrude above the upper face of said ink absorbing member in a state with the suctioning opening of said cap and said ink absorbing member in contact.

18. An ink-jet recording apparatus according to claim 13, wherein at least one of said holding member and said ink absorbing member is formed of an elastic material, and wherein said holding member and said ink absorbing member are disposed in a compressed state.

19. An ink-jet recording apparatus according to claim 13, wherein an elastic member which deforms by contact with said ink absorbing member of said holding member is disposed at the point of contact with said ink absorbing member.

20. An ink-jet recording apparatus according to claim 19, wherein a hole for accepting said holding member is formed in said ink absorbing member, and wherein said elastic member is disposed on said holding member so as to come into contact with the inner wall of said hole.

21. An ink-jet recording apparatus according to claim 19, wherein said elastic member is integrally provided with said cap and said holding member by the same material as that of said cap.

22. An ink-jet recording apparatus according to claim 19, wherein said elastic member is a rib.

23. An ink-jet recording apparatus according to claim 22, wherein the width of said rib is 0.3 mm or less.

24. An ink-jet recording apparatus according to claim 22, wherein said rib has a cross-sectional form of a triangle with the apex thereof toward said ink absorbing member.

25. An ink-jet recording apparatus according to claim 13, wherein said recording head generates bubbles in ink using thermal energy, and discharges ink based on the generating of said bubbles.

* * * * *

UNITED STATES PATENT AND TRADEMARK OFFICE

CERTIFICATE OF CORRECTION

PATENT NO. : 6,641,250 B2
DATED : November 4, 2003
INVENTOR(S) : Saito

It is certified that error appears in the above-identified patent and that said Letters Patent is hereby corrected as shown below:

Title page,
Item [56], References Cited, FOREIGN PATENT DOCUMENTS, "2000062202" should read -- 2000 - 062202 --.

Column 3,
Line 37, "resulting" should read -- resulting in --.

Column 5,
Line 20, "is a prospective" (second ocurrence) should be deleted.

Column 8,
Line 44, "an" should read -- and --.

Column 11,
Line 66, "us" should read -- is --.

Column 12,
Line 40, "exchange" should read -- exchanged --.

Column 17,
Line 53, "cause" should read -- caused --.

Column 18,
Line 38, "the" (second occurrence) should read -- The --.

Column 19,
Line 57, "has" should read -- as --.

Column 20,
Line 65, "resent" should read -- reset --.

Column 23,
Lien 56, "the an" should read -- an --.

Column 25,
Line 23, "will" should read -- with --; and
Line 45, "M5001" should read -- M5001. --.

Column 26,
Line 62, "protruding" (first occurrence) should be deleted.

UNITED STATES PATENT AND TRADEMARK OFFICE

CERTIFICATE OF CORRECTION

PATENT NO. : 6,641,250 B2
DATED : November 4, 2003
INVENTOR(S) : Saito

It is certified that error appears in the above-identified patent and that said Letters Patent is hereby corrected as shown below:

Column 27,
Line 50, "adhere" should read -- adhereing --.

Column 28,
Line 15, "corresponding" should read -- correspond --; and
Lien 51, "the" should read -- The --.

Signed and Sealed this

Twenty-fourth Day of August, 2004

JON W. DUDAS
*Director of the United States Patent and Trademark Office*